US012258158B2

(12) United States Patent
Gamboa et al.

(10) Patent No.: US 12,258,158 B2
(45) Date of Patent: Mar. 25, 2025

(54) FOOD DELIVERY SYSTEM FOR PACKAGING OF FOOD AND METHOD OF DELIVERING FOOD TO BE PACKAGED

(71) Applicant: Grupo Bimbo, S.A.B. de C.V., Mexico D.F. (MX)

(72) Inventors: Jose Antonio Contreras Gamboa, Fort Worth, TX (US); Gerald Edward Holt, St. Charles, MO (US)

(73) Assignee: GRUPO BIMBO S.A.B. DE C.V., Mexico D.F. (MX)

( * ) Notice: Subject to any disclaimer, the term of this patent is extended or adjusted under 35 U.S.C. 154(b) by 0 days.

(21) Appl. No.: 18/303,794

(22) Filed: Apr. 20, 2023

(65) Prior Publication Data

US 2024/0351721 A1 Oct. 24, 2024

(51) Int. Cl.

| | |
|---|---|
| ***B65B 25/16*** | (2006.01) |
| ***B65B 5/08*** | (2006.01) |
| ***B65B 35/44*** | (2006.01) |
| ***B65B 35/58*** | (2006.01) |
| ***B65B 57/14*** | (2006.01) |

(Continued)

(52) U.S. Cl.

CPC ..... *B65B 25/16* (2013.01); *B65B 5/08* (2013.01); *B65B 35/44* (2013.01); *B65B 35/58* (2013.01); *B65B 57/14* (2013.01); *B65B 57/20* (2013.01); *B65B 65/003* (2013.01)

(58) Field of Classification Search

CPC ..... B65B 25/16; B65G 2203/041; G01N 2021/845

See application file for complete search history.

(56) References Cited

U.S. PATENT DOCUMENTS 6,471,044 B1 * 10/2002 Isaacs et al. ..... B65G 47/682 198/460.1
2004/0151364 A1 * 8/2004 Kenneway et al. .. B07C 5/3422 382/152

(Continued)

FOREIGN PATENT DOCUMENTS

CN 109533446 A * 3/2019 ..... B65B 25/16
CN 114926435 A * 8/2022 ..... B65B 57/20

(Continued)

OTHER PUBLICATIONS

U.S. Appl. No. 18/639,552, filed Apr. 18, 2024, Gamboa et al.

(Continued)

*Primary Examiner* — Stephen F. Gerrity
(74) *Attorney, Agent, or Firm* — Crowell & Moring LLP; John C. Freeman

(57) ABSTRACT

A flipping station including a moving surface upon which an upside-down food item is placed and a ramp spaced from the moving surface so that a gap is defined between the moving surface and the ramp. The moving surface is moving at a sufficient speed so that the upside-down food item has sufficient momentum to travel past the gap and land on the ramp. A contact surface that is positioned past the gap at a contact position and is positioned above the ramp so that the upside-down food item is deflected backwards by the contact surface into the gap and the upside-down food item rotates 180° so as to land right-side up on a landing surface located below the ramp.

32 Claims, 27 Drawing Sheets

(51) Int. Cl.
*B65B 57/20* (2006.01)
*B65B 65/00* (2006.01)

(56) References Cited

U.S. PATENT DOCUMENTS

2005/0099620 A1* 5/2005 De La Ballina et al. ..... G01B 11/2433 356/237.1
2006/0070927 A1 4/2006 Henry
2008/0251350 A1* 10/2008 Alexander et al. .... B65G 47/24 198/370.08
2010/0101191 A1 4/2010 Lindee
2011/0050880 A1* 3/2011 Bourg, Jr. et al. ..... G06T 7/90 382/110
2016/0311628 A1* 10/2016 Roehring et al. ..... B65G 21/14
2019/0000094 A1 1/2019 Hjalmarsson et al.
2019/0389665 A1 12/2019 Sherman et al.
2020/0055678 A1* 2/2020 Shaw et al. ..... G01N 21/27
2020/0379427 A1* 12/2020 Tao et al. ..... G06N 3/045
2021/0100256 A1* 4/2021 Youngs et al. ..... G01N 33/12
2021/0321820 A1 10/2021 Hendershot et al.
2022/0118483 A1* 4/2022 Kjaer ..... A22C 17/0073
2022/0270269 A1* 8/2022 Pattison et al. ..... G06T 7/248
2023/0148640 A1* 5/2023 Takai et al. ..... G01N 21/85 426/46
2024/0025650 A1 1/2024 Lawrence
2024/0053277 A1* 2/2024 Ookita et al. ..... G06T 7/0006

FOREIGN PATENT DOCUMENTS

EP 4 202 765 A1 6/2023
IT TN20090011 A1 * 3/2011 ..... B65G 2203/041

OTHER PUBLICATIONS

PCT/ISA/206 Invitation to Pay Additional Fees And, Where Applicable, Protest Fee (Date of Mailing: Jun. 25, 2024) out of corresponding PCT Application PCT/US2024/025173 (two pages).
Notification of the Transmittal of the International Search Report (1) page; International Search Report (4 pages); and the Written Opinion of the International Searching Authority (12 pages) out of corresponding PCT Application PCT/US2024/025173 (17 pages total); Date of Mailing: Oct. 18, 2024.

* cited by examiner

| GROUPS | LANES<br>1 2 3 4 5 6 7 8 | Comments |
|---|---|---|
| 1 | 9 7 7 5 7 7 7 7 | Initial Quantity of Buns in the Lanes of 150 |
| 1.B<br>1.A<br><br><br><br>1.Result |  | <br><br><br>Balancer Station<br><br>Onward to Next Step |
| 2 | 7 6 6 5 6 6 6 6 | Remaining Quantity in Lanes of 150 after Step 1 |
| 2.B<br>2.A<br><br><br><br>2.Result |  | <br><br><br><br><br>Onward to Next Step |
| 3 | 5 5 5 5 5 5 5 5 | Resultant Quantity in the Lane of 150 |
| 3.B<br>3.A<br><br><br><br>3.Result |  | <br><br><br><br><br>To Bagger |

| | | |
|---|---|---|
| 4 | 4 4 4 4 4 4 4 4 | Resultant Quantity in the Lane of 150 |
| 4.B<br>4.A<br><br><br>4.Result |  | To Bagger |
| 5 | 3 3 3 3 3 3 3 3 | Resultant Quantity in the Lane of 150 |
| 4.B<br>5.A<br><br><br>5.Result |  | To Bagger |
| 6 | 2 2 2 2 2 2 2 2 | Resultant Quantity in the Lane of 150 |
| 6.B<br>6.A<br><br><br>6.Result |  | To Bagger |
| 7 | 1 1 1 1 1 1 1 1 | Resultant Quantity in the Lane of 150 |
| 7.B<br>7.A<br><br><br>7.Result |  | To Bagger |

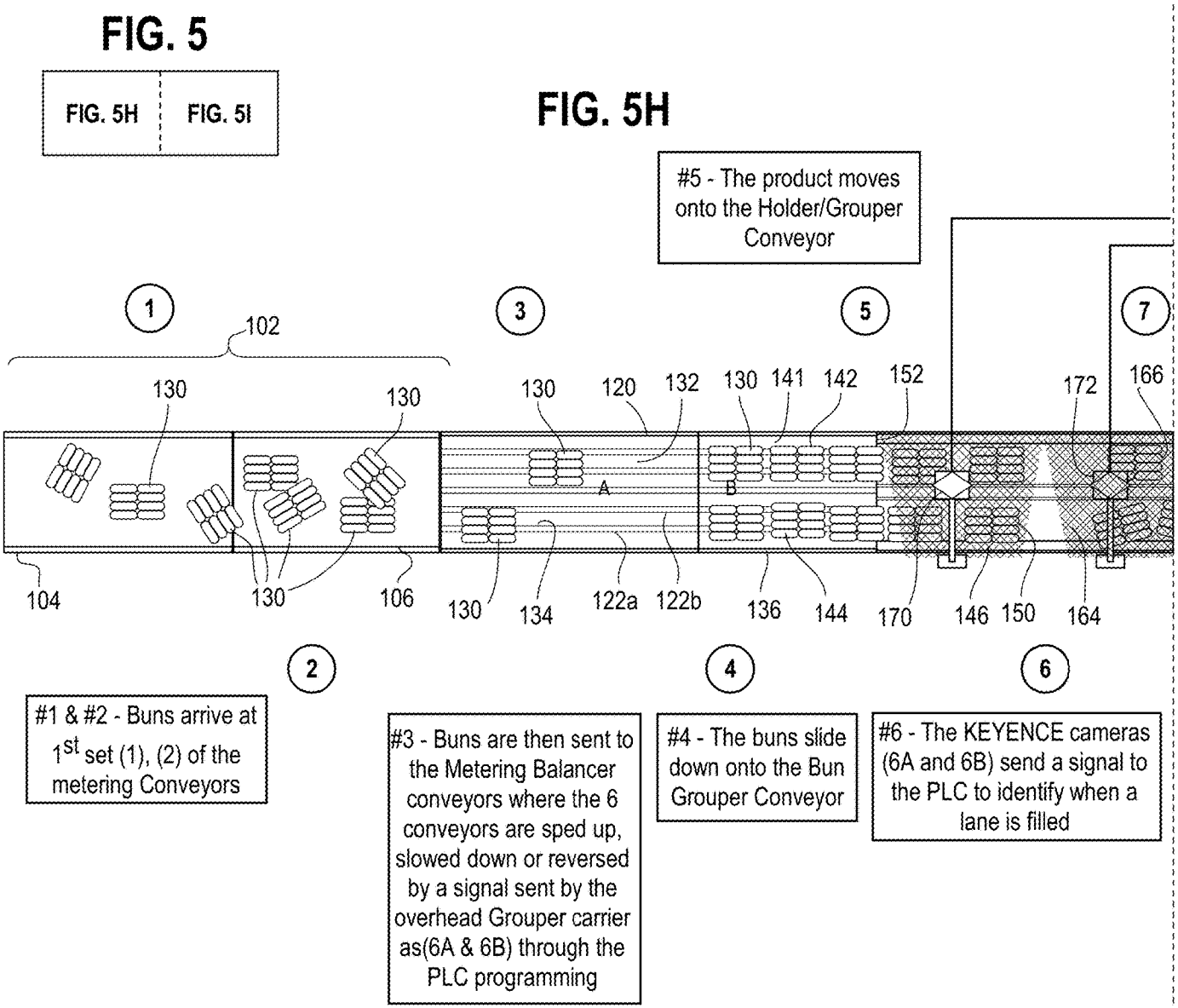
FIG. 5
FIG. 5H
FIG. 5I
FIG. 5H
#1 & #2 - Buns arrive at 1st set (1), (2) of the metering Conveyors
#3 - Buns are then sent to the Metering Balancer conveyors where the 6 conveyors are sped up, slowed down or reversed by a signal sent by the overhead Grouper carrier as(6A & 6B) through the PLC programming
#4 - The buns slide down onto the Bun Grouper Conveyor
#5 - The product moves onto the Holder/Grouper Conveyor
#6 - The KEYENCE cameras (6A and 6B) send a signal to the PLC to identify when a lane is filled
1
2
3
4
5
6
7
102
104
106
120
122a
122b
130
132
134
136
141
142
144
146
150
152
164
166
170
172
A
B

FOOD DELIVERY SYSTEM FOR PACKAGING OF FOOD AND METHOD OF DELIVERING FOOD TO BE PACKAGED

BACKGROUND OF THE INVENTION

Technical Field

The present invention is directed to a delivery system and a method of delivering a product that allow the product to be properly fed to a packaging system. In particular, the delivery system and method of delivering a product are directed to properly feeding and orienting baked foods, such as bread rolls and buns, which include hot dog buns and hamburger buns, so as to be properly oriented to be inserted into a bag.

Background Art

It is well known to orient food by hand prior to the food being placed in a package. In the case of the packaging of hot dog buns, two pieces of dough are placed on a pan and placed in an oven. After baking is completed, two sets of four hot dog buns are present on the pan. Since the top portions of the sets of hot dog buns were directly exposed to the heat of the oven, they have a brown color. The bottom portions of the sets of hot dog buns were not directly exposed to the heat of the oven and so they have a lighter brown color when compared with the top portions of the sets of hot dog buns. In addition, if there was flour accidently present on the surface of the pan during the baking process, white spots can appear on those areas of the bottom portions of the sets of hot dog buns that were in contact with the flour. As shown in FIG. 1A, the tops 10 of the hot dog buns 12 in a set have a consistent brown color. As shown in FIG. 1B, the bottoms 14 of the hot dog buns 12 in a set have a lighter brown color with white patches 16 present. Thus, there is a color differential between the tops 10 and the bottoms 14 of the hot dog buns 12.

It is well known that the packaging of sets of hot dog buns is accomplished by delivering recently baked set of hot dog buns on a conveyor that moves the sets of hot dog buns to a machine called a bagger. The conveyor can have one to twelves lanes of food to be packaged. The bagger places one or more sets of hot dog buns into a bag. When the bag contains the desired number of sets of hot dog buns (two sets of four hot dog buns in most cases), it is closed in a well-known manner and later shipped to a store for sale to consumers.

While on the conveyor and prior to being processed by the bagger, the sets of hot dog buns are positioned randomly on the conveyor, such that some sets are upside down and some sets are not aligned parallel to the direction of travel of the conveyor toward the bagger. One or more persons, known as operators, are positioned besides the conveyor and must manually execute essentially four things:

a) Ensure there is an even flow of single hot dog buns or sets of hot dog buns (depending on the hot dog buns to be packaged) in product lanes that direct the single hot dog buns or sets of hot dog buns to the bagger. Achieving such an even flow requires an operator to manually balance the flow of the single hot dog buns or sets of hot dog buns by moving the single hot dog buns or sets of hot dog buns around and across the product lanes.

b) Ensure that each of the single hot dog buns or sets of hot dog buns are positioned so their tops are correctly right-side up so that the bottoms of the single hot dog buns or sets of hot dog buns contact the moving surface of the conveyor.

c) Ensure that each of the single hot dog buns or sets of hot dog buns are correctly oriented relative to the conveyor and the bagger. As shown schematically in the top view of FIG. 2, a set of hot dog buns 12 are located on a conveyor belt 18 that is moving downward as indicated by the arrow. The conveyor belt 18 defines a longitudinal axis $L_c$. As show in FIG. 2, the longitudinal axis $L_B$ of a hot dog bun 12 defines an acute angle θ relative to the longitudinal axis $L_c$. Typically, the acute angle is approximately 90°. Correct orientation of a hot dog bun 12 on the conveyor 18 is achieved when either of the ends 20, 22 of the hot dog buns 12 are pointed downstream towards the bagger along or parallel with the longitudinal axis $L_c$ so that the angle θ has a value of 0°.

d) Ensure that the single hot dog buns or sets of hot dog buns are complete in that the single hot dog buns are not attached to other hot dog buns or the set of hot dog buns has the correct number of hot dog buns, and the single hot buns or the sets of hot dog buns do not contain damaged or misshapen buns. For example, as shown in FIGS. 1A-B and 2, the sets of hot dog buns 12 present are complete since they are not damaged and they each have the correct number of four hot dogs 12.

When an operator determines that a single hot dog bun or a set of hot dog buns does not achieve one or more of goals a)-c) mentioned previously, the operator manually manipulates the single hot dog bun or the set of hot dog buns in question to achieve the one or more goals a)-c). When an operator determines that goal d) is not achieved for a particular single hot dog bun or a set of hot dog buns, that particular single hot dog bun or set of hot dog buns is removed from the conveyor 18.

Note that it is well known to manually orient other sets of hot dog buns that contain different numbers of hot dogs, such as 3, 2, or 1. In such situations, human operators are charged with the same goals a)-d) mentioned previously with respect to the set of four hot dog buns described previously and shown in FIGS. 1A-B and 2.

It is also well known to have human operators orient other foods pursuant to one or more of the goals a)-d) mentioned previously depending on the food being handled. For example, in the case that the food to be packaged is a set of four hamburger buns that form two rows and two columns, the longitudinal axis $L_B$ of goal c) is taken along a line connecting the centers of two hamburger buns in the same row or in the same column. In the case that there are only single hamburger buns to be packaged, then goal c) does not apply due to the circular and symmetric shape of each single hamburger bun.

In each of the prior described tasks for operators, there are errors performed by the operators. For example, due to the speed of the conveyor and the number of pieces and/or sets of food on the conveyor, it may be difficult to evenly feed the pieces and/or sets of the food delivered to the bagger. If the food is not evenly fed, then there may be a back-up that develops at the bagger that would cause the conveyor to be shut down so that either the pieces and/or sets of the food can be rearranged or scrapped as waste for better feeding of the bagger. Such a shutdown results in the packaging process being less efficient.

Another problem with the use of human operators in performing the prior described tasks, is that it can be difficult to determine whether pieces and/or sets of the food are right-side up. Accordingly, some packaged foods may have the food incorrectly positioned upside down within the package relative to the other food within the package.

Another problem with the use of human operators in performing the previously described tasks is that the operators are positioned on the side of the conveyor and so there will be errors in correctly determining whether pieces and/or sets of the food are correctly oriented to be received by the bagger. If they are not correctly oriented, then the bagger may not be able to receive and package such foods and, thus, a log jam may result at the bagger. Again, the conveyor will need to be shut down to reposition the food or scrap some of the food so that the bagger can accept food on the conveyor.

Another problem with the use of human operators in performing the prior described tasks is that the conveyor must be run at a speed so that the human operators can perform tasks a)-d) mentioned previously. Thus, the amount of food being processed per hour is limited by the human operator's ability to identify that one of the tasks a)-d) needs to be performed and perform such an identified task. While increasing the number of operators to perform one or more of tasks a)-d) can improve the amount of food being process per hour, it will lead to increased labor costs that will need to be passed on to the consumer.

SUMMARY OF THE INVENTION

One aspect of the present invention regards a delivery system that includes a balancer station having a surface upon which multiple food items are placed. A grouper station has a surface to receive the multiple food items from the balancer station or to send the multiple food items to the balancer station. A controller that is in communication with the balancer station and sends control signals to the balancer station to control distribution of either the multiple food items of the balancer station to the grouper station or the multiple food items of the grouper station to the balancer station. A camera that generates pixels representing images of each of the multiple food items on the surface of the grouper station, wherein signals based on the pixels are sent from the camera to the controller and the control signals sent to the balancer station are based on numbers of the pixels.

A second aspect of the present invention regards a delivery system that includes a surface upon which multiple food items are placed and a camera positioned above the surface and which takes a digital picture of the multiple food items on the surface. A processor that analyzes colored pixels of top portions of each of the multiple food items that face the camera and determines whether there exist colored pixels of the top portions that have a value that corresponds to a first color of a bottom of the multiple food items or a second color of a top of the multiple food items, wherein if there exists a colored pixel of one of the top portions that has a value that corresponds to the first color, the processor will designate the food item associated with the top portion as being upside down.

A third aspect of the present invention regards a flipping station including a moving surface upon which an upside-down food item is placed and a ramp spaced from the moving surface so that a gap is defined between the moving surface and the ramp. The moving surface is moving at a sufficient speed so that the upside-down food item has sufficient momentum to travel past the gap and land on the ramp if unimpeded. A contact surface that is positioned past the gap at a contact position and is positioned above the ramp so that the upside-down food item is deflected backwards by the contact surface into the gap and the upside-down food item rotates 180° so as to land right-side up on a landing surface located below the ramp.

A fourth aspect of the present invention regards a method of delivering multiple food items that includes either placing multiple food items on a surface of a balancer station and receiving on a surface of a grouper station the multiple food items from the balancer station or placing multiple food items on the surface of the grouper station and sending the multiple food items on the surface of the grouper station to the surface of the balancer station. Controlling distribution of either the multiple food items of the balancer station to the grouper station or the multiple food items of the grouper station to the balancer station. Generating pixels representing images of each of the multiple food items on the surface of the grouper station, wherein signals based on numbers of the pixels for each of the multiple food items are used for the controlling distribution of either the multiple food items of the balancer station to the grouper station or the multiple food items of the grouper station to the balancer station.

A fifth aspect of the present invention regards a method of delivery that includes placing multiple food items on a surface and taking a digital picture of the multiple food items on the surface by a camera. Analyzing colored pixels of top portions of each of the multiple food items that face the camera and determining whether there exist colored pixels of the top portions that have a value that corresponds to a first color of a bottom of the multiple food items or a second color of a top of the multiple food items, wherein if there exists a colored pixel of one of the top portions that has a value that corresponds to the first color, designating the food item associated with the top portion as being upside down.

One or more aspects of the present invention provide the advantage of evening the food delivered to a bagger so as to avoid the backing up of food at the bagger.

One or more aspects of the present invention provide the advantage of more accurate orientation of food to be delivered to and packaged by a bagger.

One or more aspects of the present invention provide the advantage of increasing the number of food delivered to and packaged by a bagger per hour.

One or more aspects of the present invention provide the advantage of reducing the costs of orienting food to be delivered to and packaged by a bagger.

BRIEF DESCRIPTION OF THE DRAWINGS

The various features, advantages and other uses of the present apparatus and method will become more apparent by referring to the following detailed description and drawings in which:

FIGS. 5H and 5I show a top schematic view of the delivery system of FIG. 3 when delivering food in accordance with the present invention;

FIG. 15 shows a perspective view of an embodiment of a flipping station of the delivery system of FIG. 3;

DETAILED DESCRIPTION

Figure 1A:
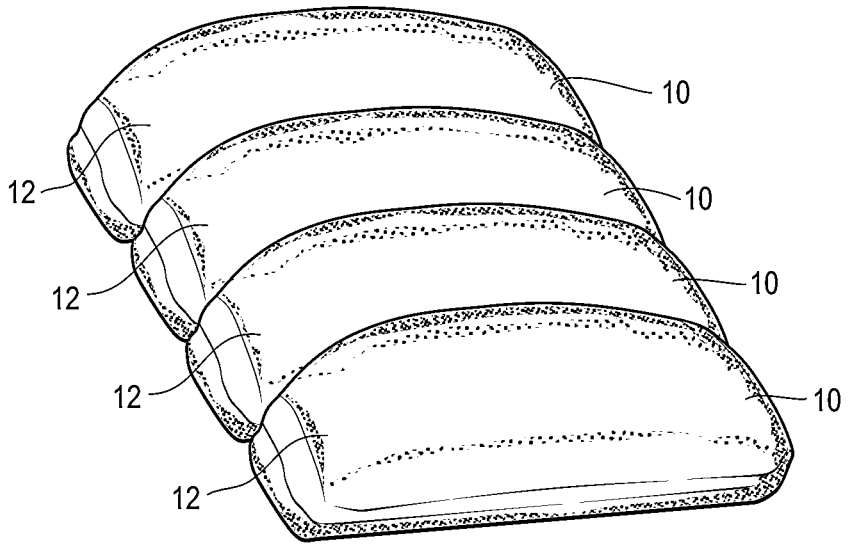
FIG. 1A shows a top perspective view of the tops of typical hot dog buns.

As shown in the exemplary drawing figures is an embodiment of a delivery system that allows for the delivery and orientation of food prior to being delivered to a bagger, wherein like elements are denoted by like numerals.

FIGS. 3-15 show an embodiment of a delivery system 100. The delivery system 100 includes a filler station 102 as shown in FIGS. 3-6. The filler station 102 has two or more filler conveyors 104, 106 that are in series with one another. Each filler conveyor 104, 106 is identical in structure and has a plastic conveyor belt 108, 110, respectively, that is blue in color and made of polypropylene.

Figure 3:
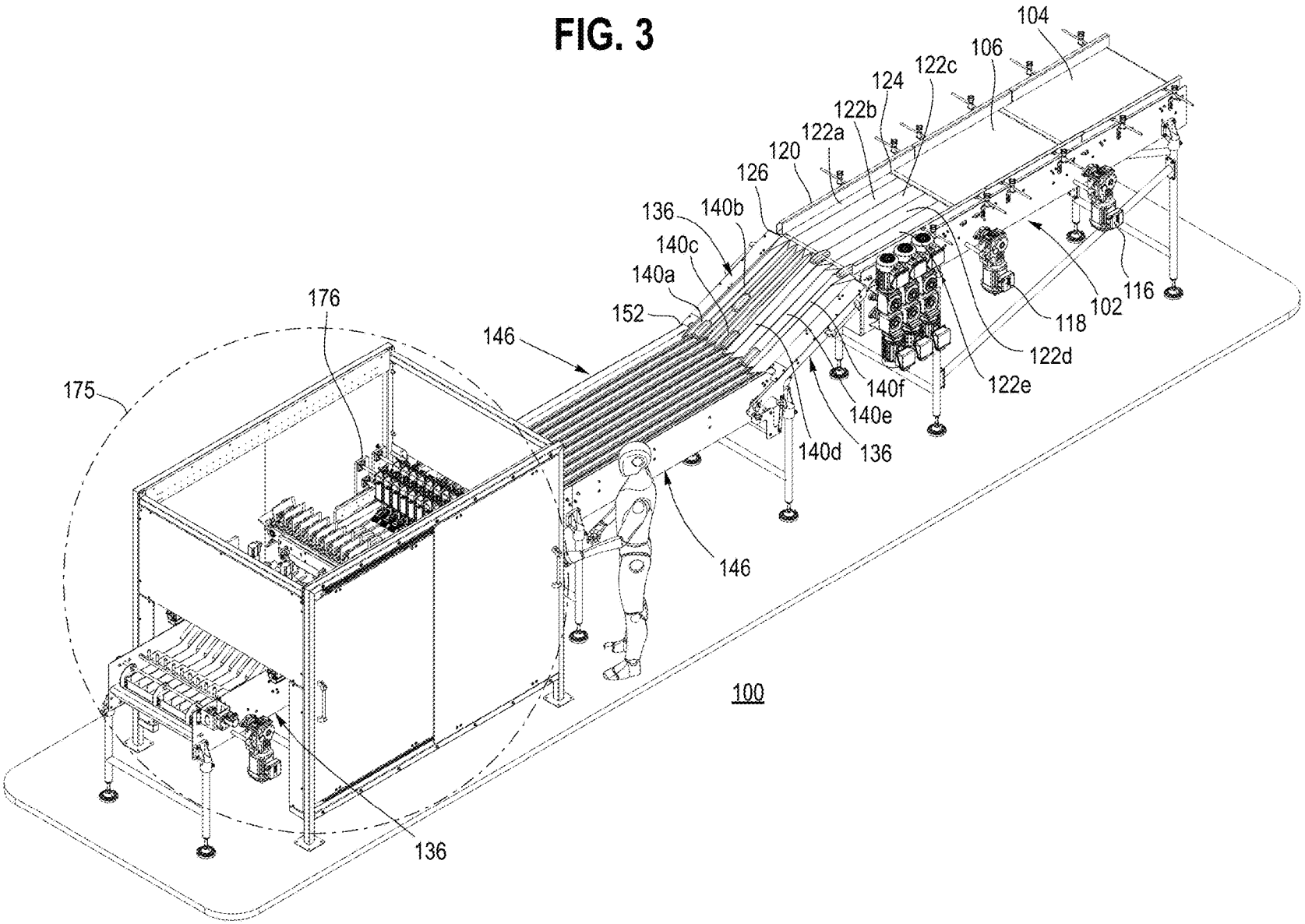
FIG. 3 shows a right elevational perspective view of an embodiment of a delivery system in accordance with the present invention.

In the case of conveyor 104, a grid of brackets is formed from longitudinal brackets 111 extending parallel to the direction of travel of the conveyor belt 108 and attached to brackets 113 that extend perpendicular to the direction of travel of the conveyor belt 108. The grid of brackets is attached to a pair of stainless-steel cover plates 115, 117. The plastic conveyor belt 108 is looped over the grid of brackets and has a width of approximately 30 inches and a length of approximately 72 inches prior to being looped. The looped plastic conveyor belt 108 has a rear end 112 that receives a roller 119, as shown in FIGS. 3B-3C, that engages the interior surface of the plastic conveyor belt 108 in a well-known manner. The front end 114 of the plastic conveyor belt 108 receives a drive roller 121 that engages the interior surface of the plastic conveyor belt 108. The distance between the roller 119 and the drive roller 121 is approximately 36 inches. The drive roller 121 is rotated by a motor 116 which results in the drive roller 121 moving the plastic conveyor belt 108 about the roller 119 at the rear end 112. The speed of the plastic conveyor belt 108 is in the range of 15 ft/min to 70 ft/min.

Figure 3A:
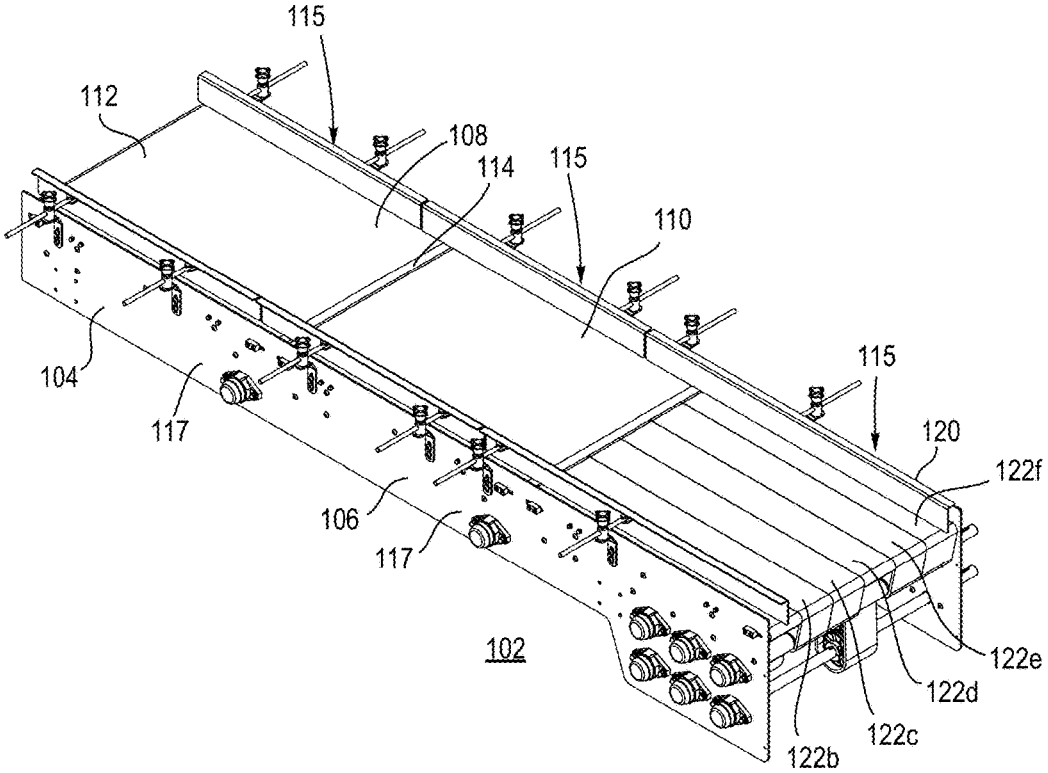
FIG. 3A shows a left elevational perspective view of an embodiment of a filler station of the delivery system of FIG. 3.
Figure 3B:
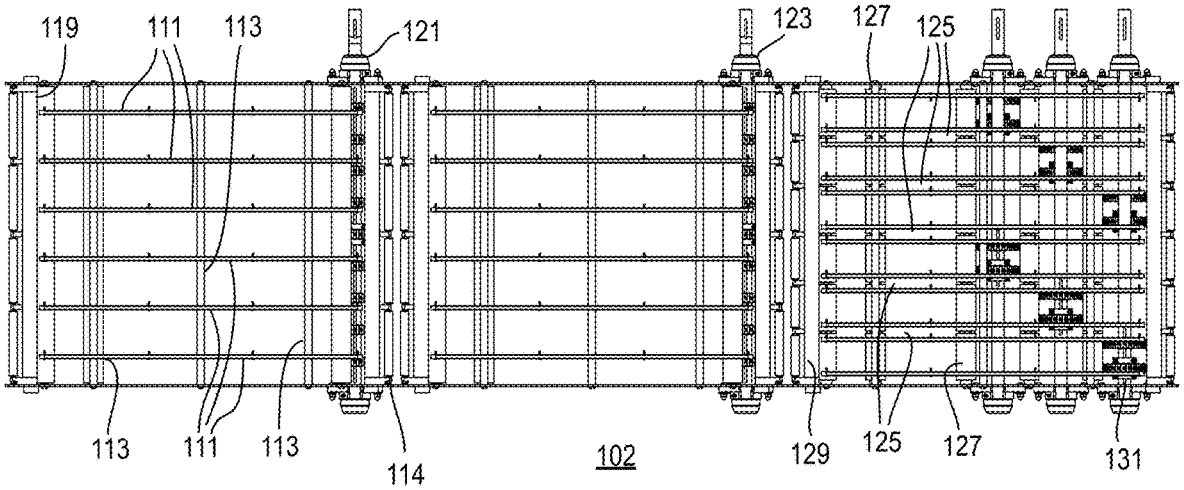
FIG. 3B shows a op view of the filler station of FIG. 3A with the conveyor belt removed.
Figure 3C:
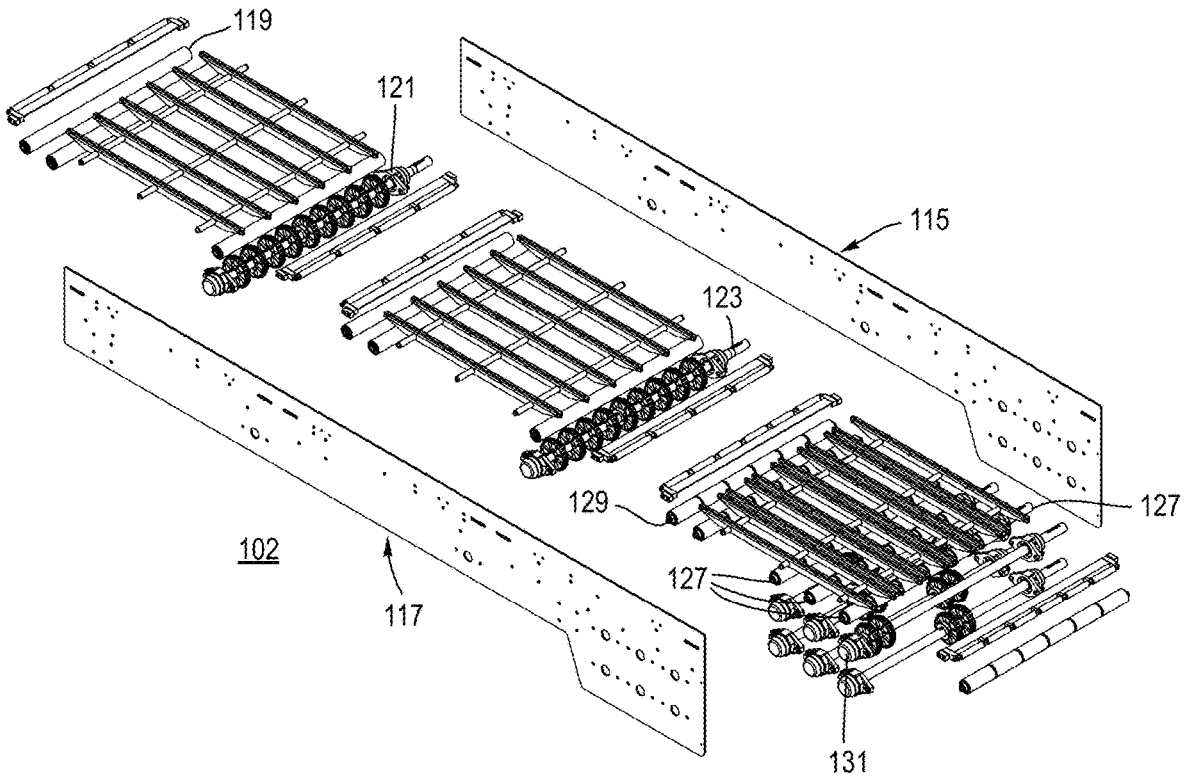
FIG. 3C shows an exploded perspective view of the filler station of FIG. 3A.
Figure 4:
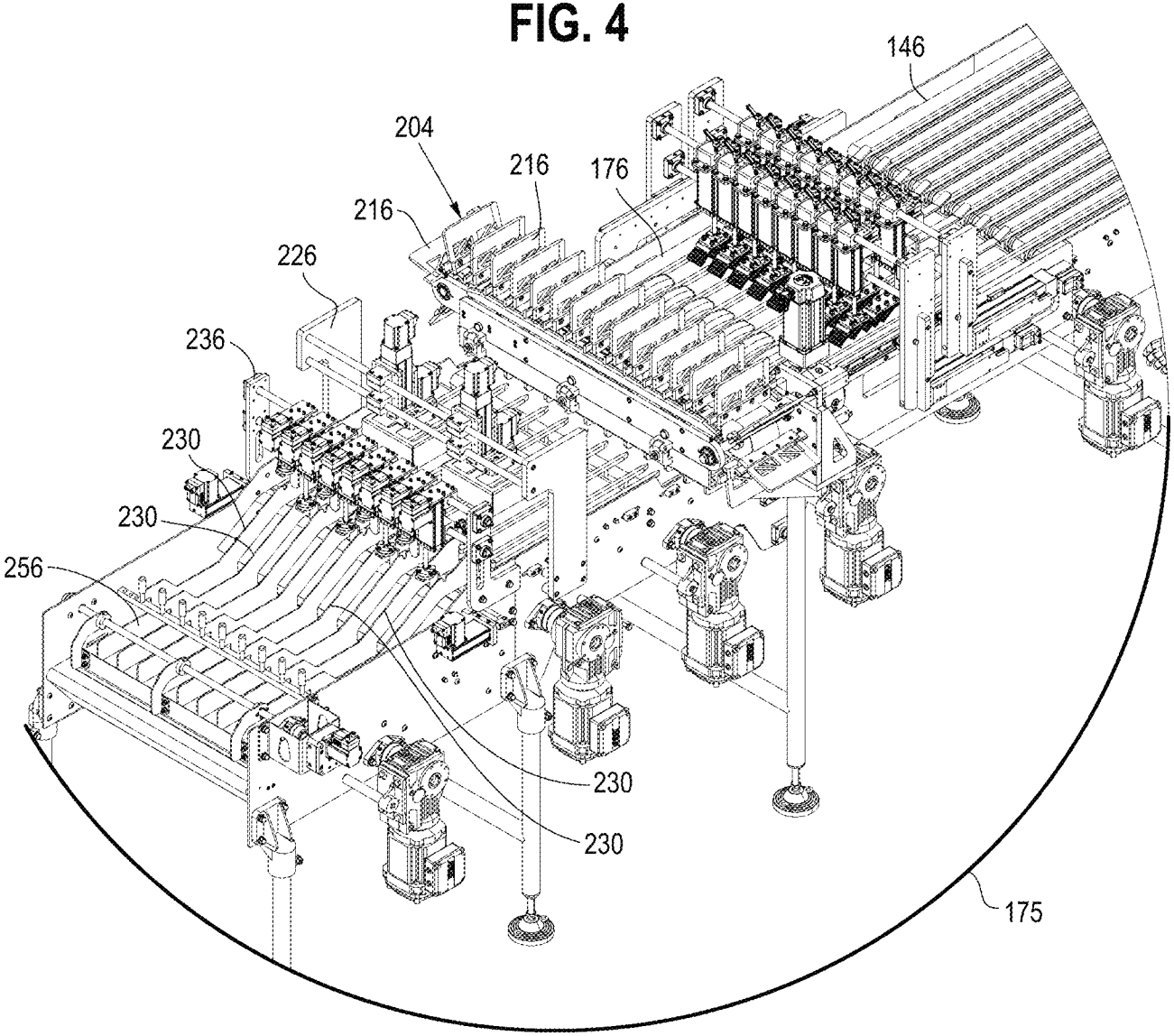
FIG. 4 shows an enlarged and exposed portion of an orientation system of the delivery system of FIG. 3.

As mentioned previously, conveyor 106 has an identical structure as conveyor 104, which is shown in FIGS. 3A-C. The drive roller 123 of the conveyor 106 is driven by a motor 118 so that the plastic conveyor belt 110 of the conveyor 106 moves at a speed ranging from 15 ft/min to 70 ft/min. Preferably, the plastic conveyor belt 110 moves simultaneously with and in the same direction as the plastic conveyor belt 108. The speed of the plastic conveyor belt 110 can be the same as the speed of the plastic conveyor belt 108 or it can be adjusted to a slower speed to allow some slight backup of the sets of hot dog buns 130 on the plastic conveyor belt 110.

In operation, food is fed or loaded onto moving conveyor 104 so that the food is moved to moving conveyor 106, which in turn delivers the food to a metering balancer station 120 as shown in FIGS. 3, 3A-C, 5H, 5I, and 7. While the food can be any food, for the purpose of this discussion the food will be hot dog buns 130 that are in sets of four. Other numbers of hot dog buns in a set are possible, such as 2 and 3. Single hot dog buns can be processed as well. In addition, the food can be sets of hamburger buns, wherein the number of hamburger buns in a set are, for example, 4, 3, or 2. Single hamburger buns can be processed by the delivery system 100.

As shown in FIGS. 3, 3A-C, 5H, 5I, and 7, the metering balancer station 120 is in series with and downstream of the moving conveyor 106. As shown in FIGS. 3B-C, the metering balancer station 120 includes a grid of brackets formed from longitudinal brackets 125 extending parallel to the direction of travel of multiple conveyor belts 122*a-f* and attached to brackets 127 that extend perpendicular to the direction of travel of the conveyor belts 122*a-f*. The grid of brackets is attached to the pair of stainless-steel cover plates 115, 117. The plastic conveyor belts 122*a-f* are looped over the grid of brackets. The metering balancer station 120 has six plastic conveyor belts 122*a-f*. Each plastic conveyor belt 122*a-f* is essentially identical to each other. Regarding plastic conveyor belt 122*a*, it has a width of approximately 5 inches and a length end to end prior to being looped of approximately 72 inches. The plastic conveyor belt 122*a* is made of a material similar to the materials of the plastic conveyor belts 108 and 110 described previously. The plastic conveyor belt 122*a* is looped and has a rear end 124 that receives a roller 129 that engages the interior surface of the plastic conveyor belt 122*a* in a well-known manner. The front end 126 of the plastic conveyor belt 122*a* receives a drive roller 131 that engages the interior surface of the plastic conveyor belt 122*a*. The distance between the roller 129 and the drive roller 131 is approximately 36 inches. The drive roller 131 is rotated by a motor 128 which results in the drive roller 131 moving the plastic conveyor belt 122*a* about the roller 129 at the rear end 124. The speed of the plastic conveyor belt 122*a* is in the range of 15 ft/min to 70 ft/min.

The plastic conveyor belts 122*b-f* have a structure similar to plastic conveyor belt 112*a* described previously. Each of the plastic conveyor belts 122*b-f* share a roller at their rear end and have their own drive roller at their front end, wherein each drive roller is driven by its own motor. Thus, the plastic conveyor belts 122*a-f* can be driven independently of each other and can be driven at different directions and speeds relative to one another. Such flexibility in speed and direction for each of the plastic conveyor belts 122*a-f* allows for the metering balancer station 120 to perform a balancing process as will be described hereinafter.

Figure 5A:
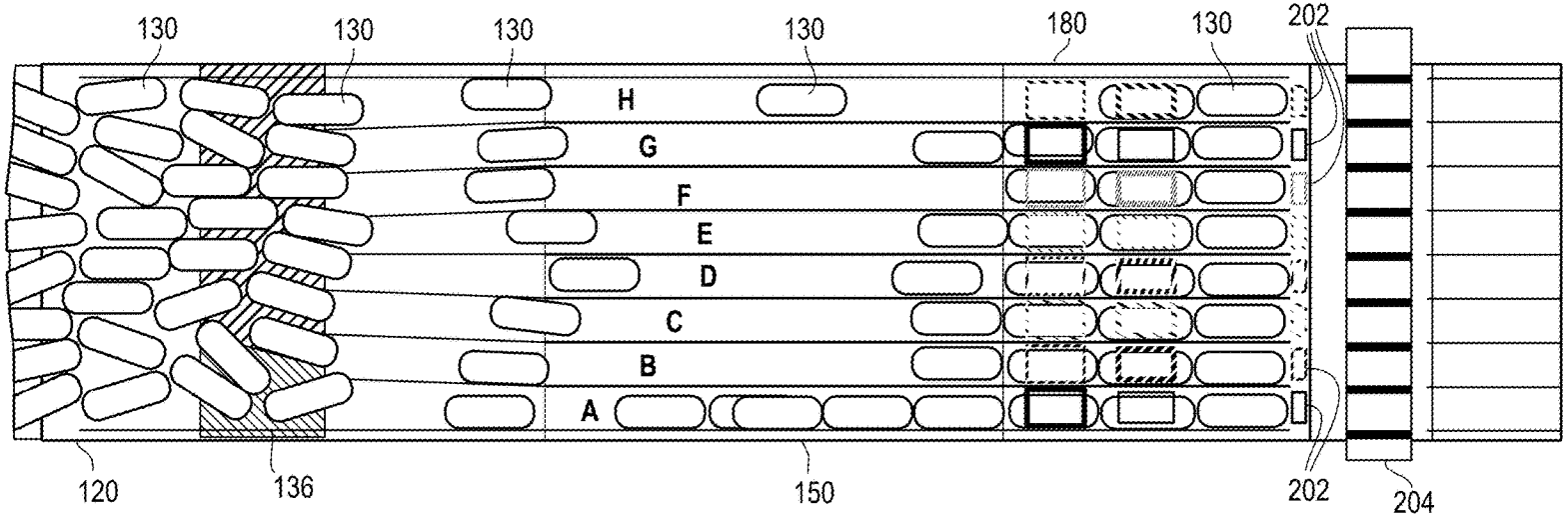
FIG. 5A shows a top schematic view of a possible arrangement of buns on a conveyor belt that need to be balanced.
Figure 5B:
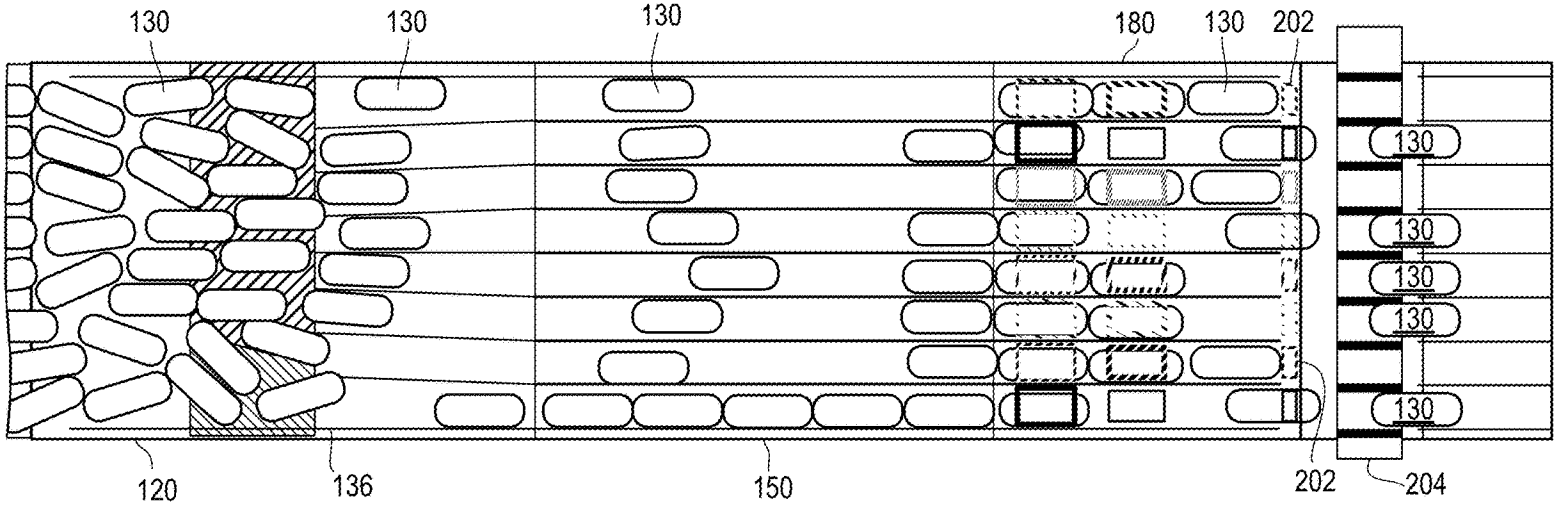
FIG. 5B shows a top schematic snap shot view of a balancing process applied to the arrangement of buns on the conveyor of FIG. 5A.
Figure 5C:
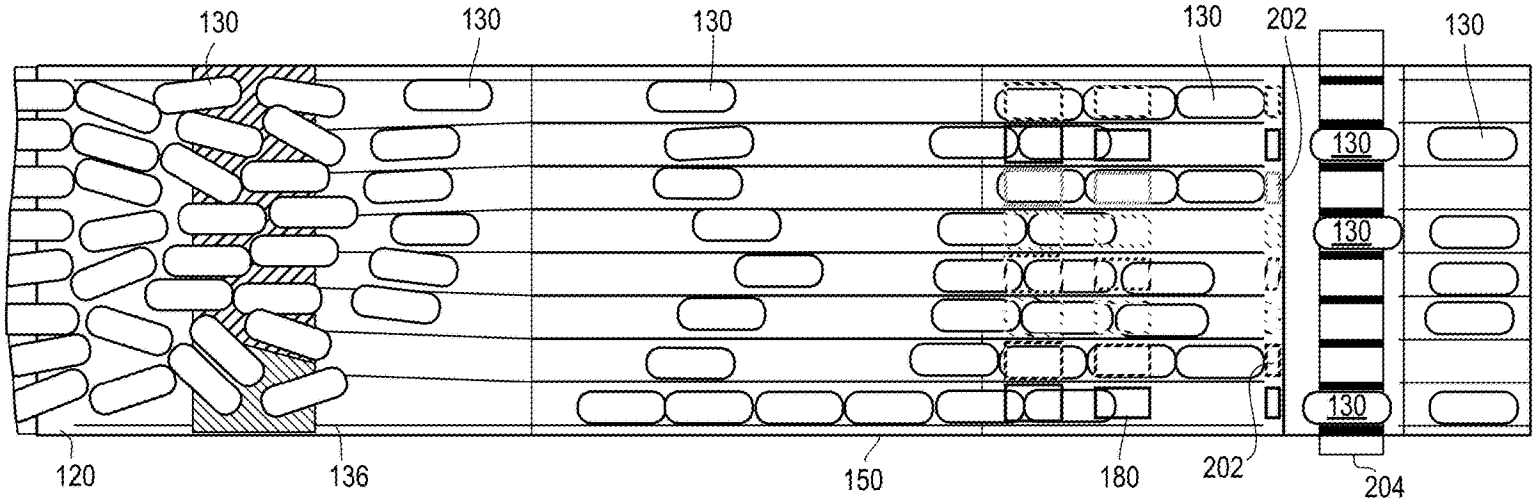
FIG. 5C shows a second top schematic snap shot view of the balancing process applied to the arrangement of buns on the conveyor of FIG. 5A.
Figure 5D:
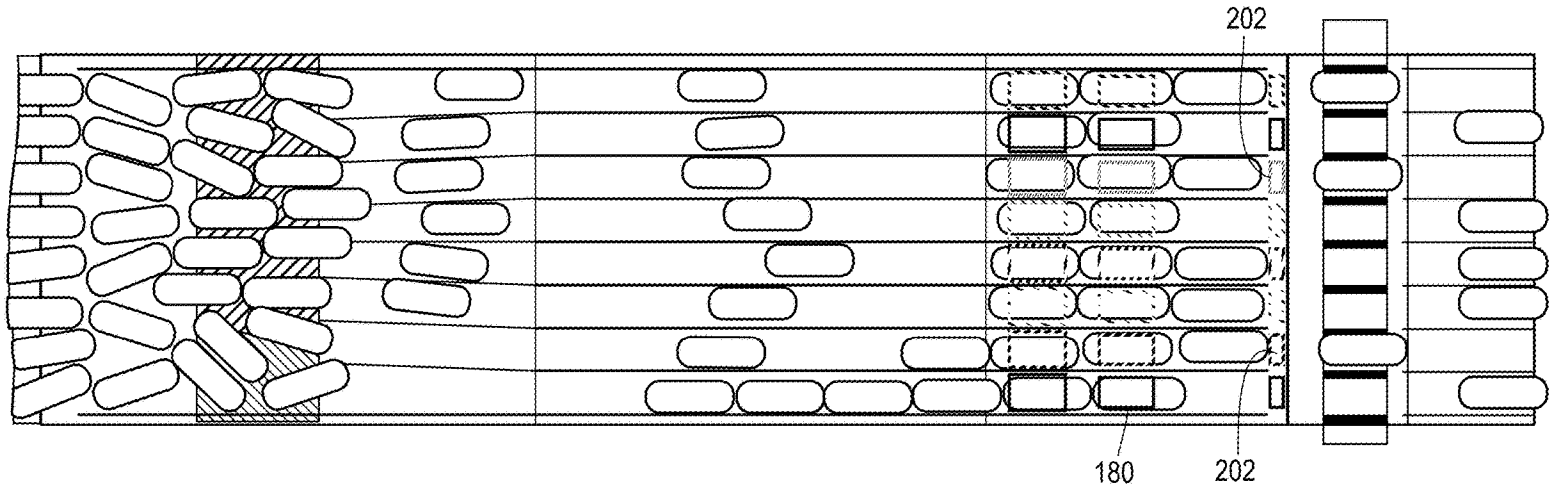
FIG. 5D shows a third top schematic snap shot view of the balancing process applied to the arrangement of buns on the conveyor of FIG. 5A.
Figure 5E:
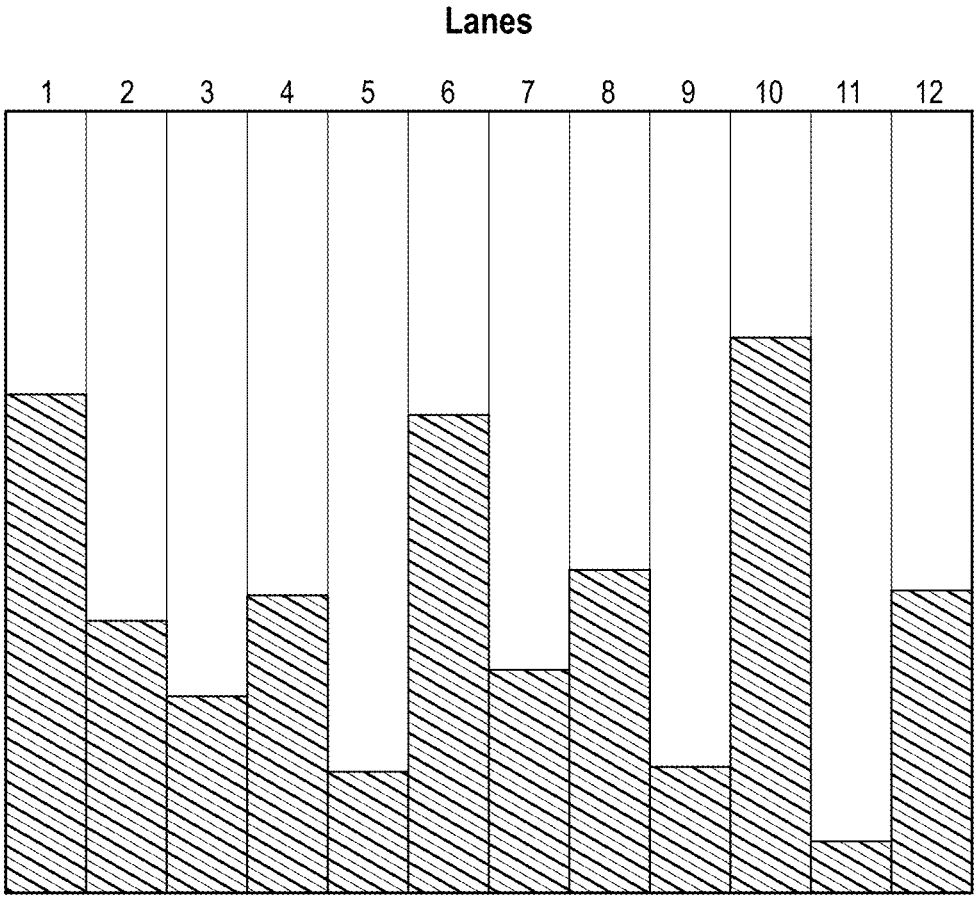
FIG. 5E schematically shows an example of cumulative lengths of single hot dog buns for each lane of a conveyor belt of a bun feed grouper station of the delivery system of FIG. 3 that are used to balance the distribution of the single hot dog buns on the conveyor belt.
Figure 5F:
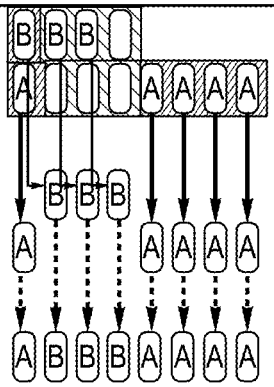
FIG. 5F shows a first set of schematic snap shot views of an example of a balancing process.
Figure 5F:
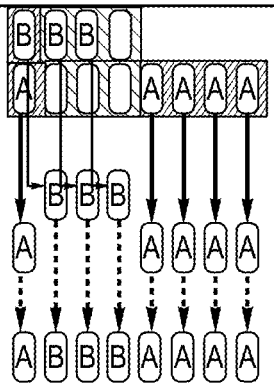
Figure 5F:
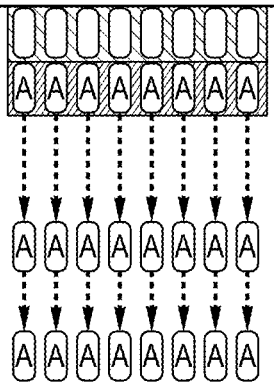
Figure 5G:
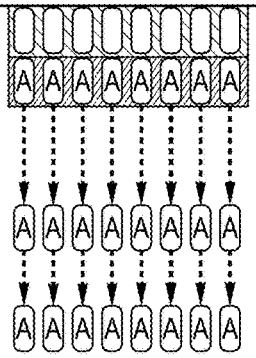
FIG. 5G shows a second set of schematic snap shot views of the balancing process of FIG. 5F.
Figure 5G:
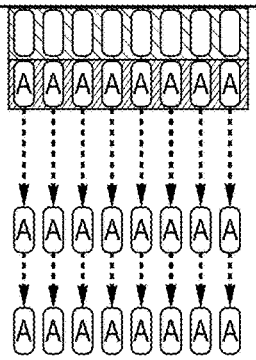
Figure 5G:
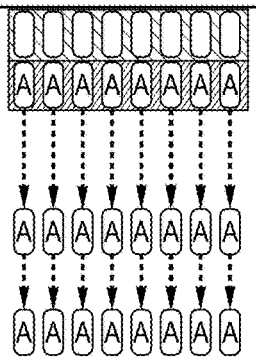
Figure 5G:
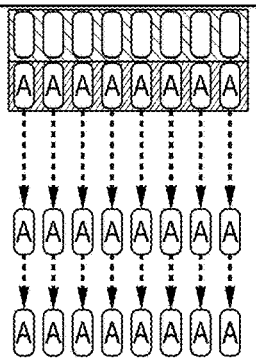
Figure 5I:
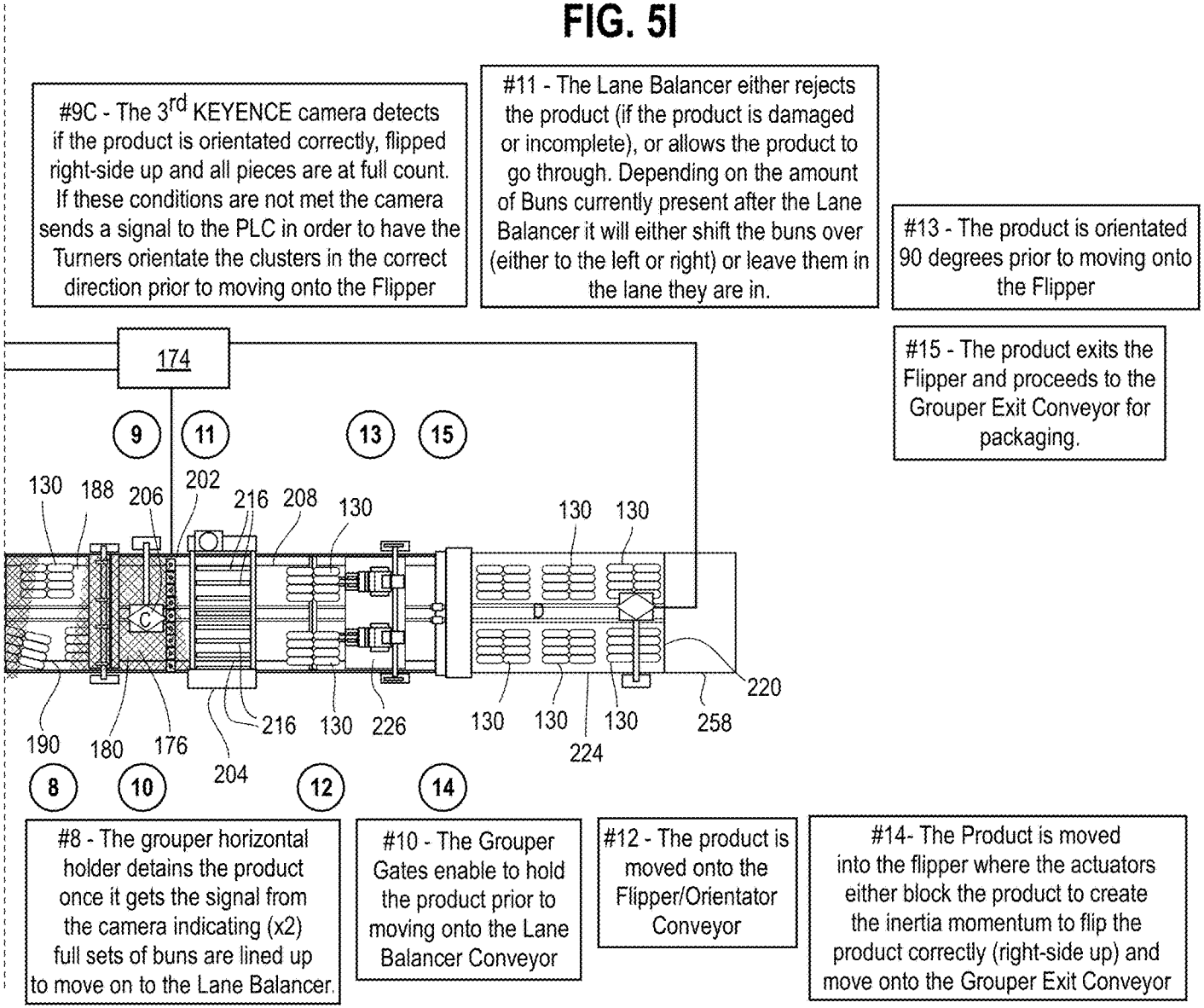

As shown in FIGS. 5H and 5I, the sets of hot dog buns 130 delivered to the moving conveyors 104 and 106 are initially randomly strewn on the top surfaces of the plastic conveyor belts 108 and 110. Such random positioning of the sets of hot dog buns 130 is not ideal when compared with the preferable arrangement where all sets of hot dog buns 130 are located in either a left lane 132 or a right lane 134 of the metering balancer station 120 (see FIGS. 5H and 5I). Note that hereinafter left is taken from the perspective of a person looking downstream of the delivery system 100 from the rear of the filler station 102.

In order to accomplish having the sets of hot dog buns 130 on the metering balancer station 120 being directed to a left lane or a right lane, the sets of hot dog buns 130 are fed to a chute 136 that has multiple channels 138*a-e* defined by stainless steel ribs 140*a-f* as shown in FIGS. 3 and 7-9. The chute 136 has a surface 141 made of stainless steel that is inclined downward from the plastic conveyor belts 122*a-f* by an angle ranging from 15 to 20 degrees. The ribs 140*a-f* are slidable relative to the surface 141 and can be locked in position thereon. The spacing between adjacent ribs is selected so as to approximate the width of the food, such as a set of hot dog buns 130, that is being delivered from metering balancer station 120. In the example shown in FIGS. 3-15, the ribs 140*a-f* are arranged to define two lanes. The number of lanes formed across the entire width of the chute 136 can be increased up to twelve in number to accommodate different sizes of foods to be packaged, wherein the width of each lane is equal to each other and approximates the width of the food being delivered from the metering balancer station 120. For example, twelve lanes would be formed when single hot dog buns are conveyed by the metering balancer station 120. In addition, the ribs 140 are aligned with guides 158, 160, and 162 of the bun feed grouper station 146 as will be described hereinafter.

Figure 8:
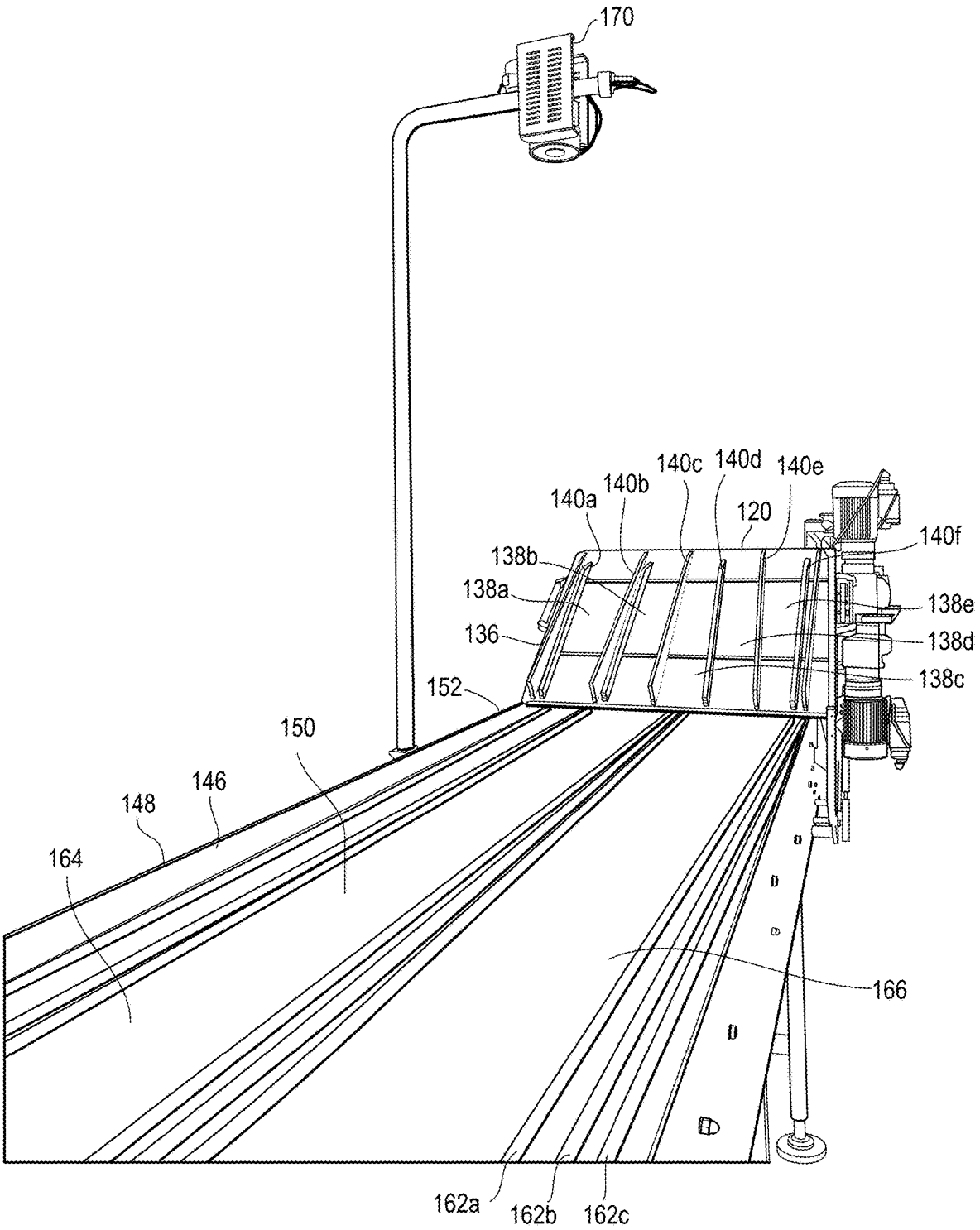
FIG. 8 shows a perspective view of an embodiment of a bun feed grouper station of the delivery system of FIG. 3.
Figure 9:
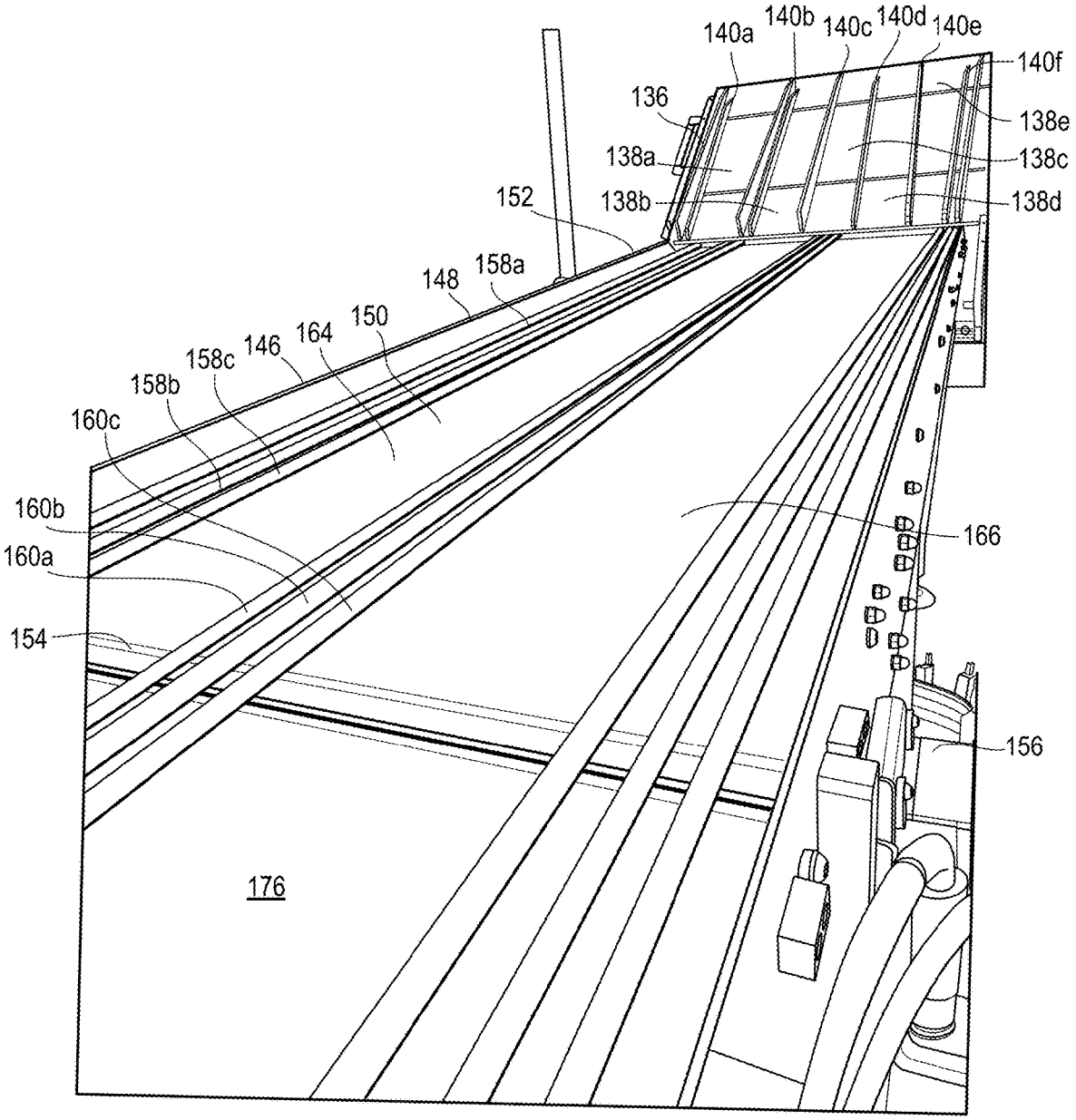
FIG. 9 shows a second perspective view of the bun feed grouper station of FIG. 8.

As shown in the top views of FIGS. 5H and 5I, when the sets of hot dog buns 130 pass through the chute 136, they travel down either a left lane 142 or a right lane 144. The sets of hot dog buns 130 are delivered by the chute 136 to a rear end of a conveyor belt 150 of a bun feed grouper station 146 located at the bottom of the chute 136. As shown in FIGS. 3, 8, and 9, the bun feed grouper station 146 includes a conveyor 148 with the conveyor belt 150, wherein the conveyor belt 150 has a width of approximately 31 inches and a length from end to end prior to being looped of approximately 204 inches. An example of a possible conveyor belt 150 to use is a conveyor belt of similar dimensions available from Intralox Co. The conveyor belt 150 has a rear end 152 that receives a roller (not shown) that engages the interior surface of the looped conveyor belt 150 in a well-known manner. The front end 154 of the looped conveyor belt 150 receives a drive roller (not shown) that engages the interior surface of the conveyor belt 150. The distance between the roller and the drive roller is approximately 102 inches. The drive roller is rotated by a motor 156 which results in the drive roller moving the conveyor belt 150 about the roller at the rear end 152. The speed of the conveyor belt 150 is in the range of 30 ft/min to 50 ft/min.

Figure 6:
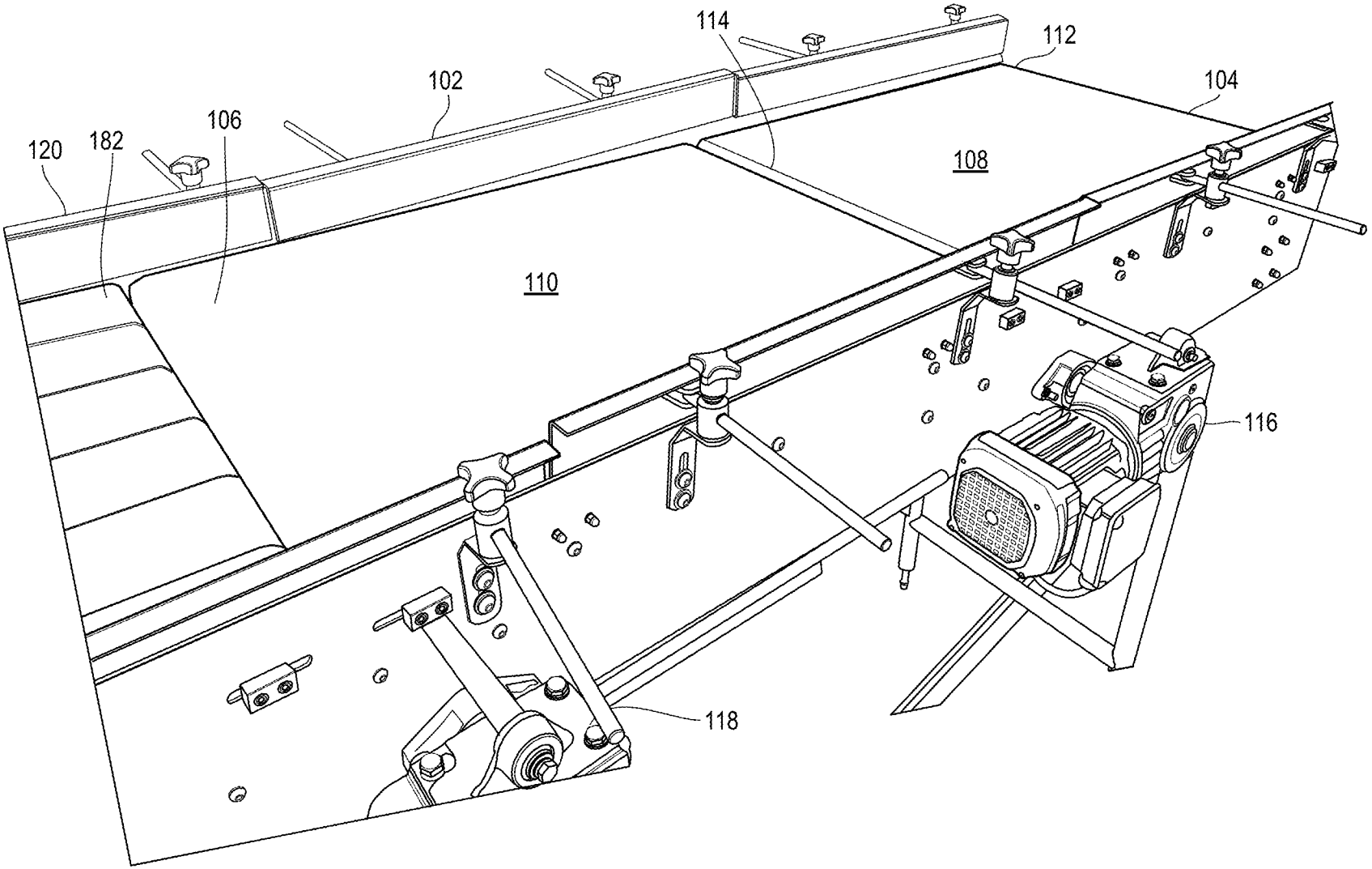
FIG. 6 shows a perspective view of an embodiment of a filler station of the delivery system of FIG. 3.
Figure 7:
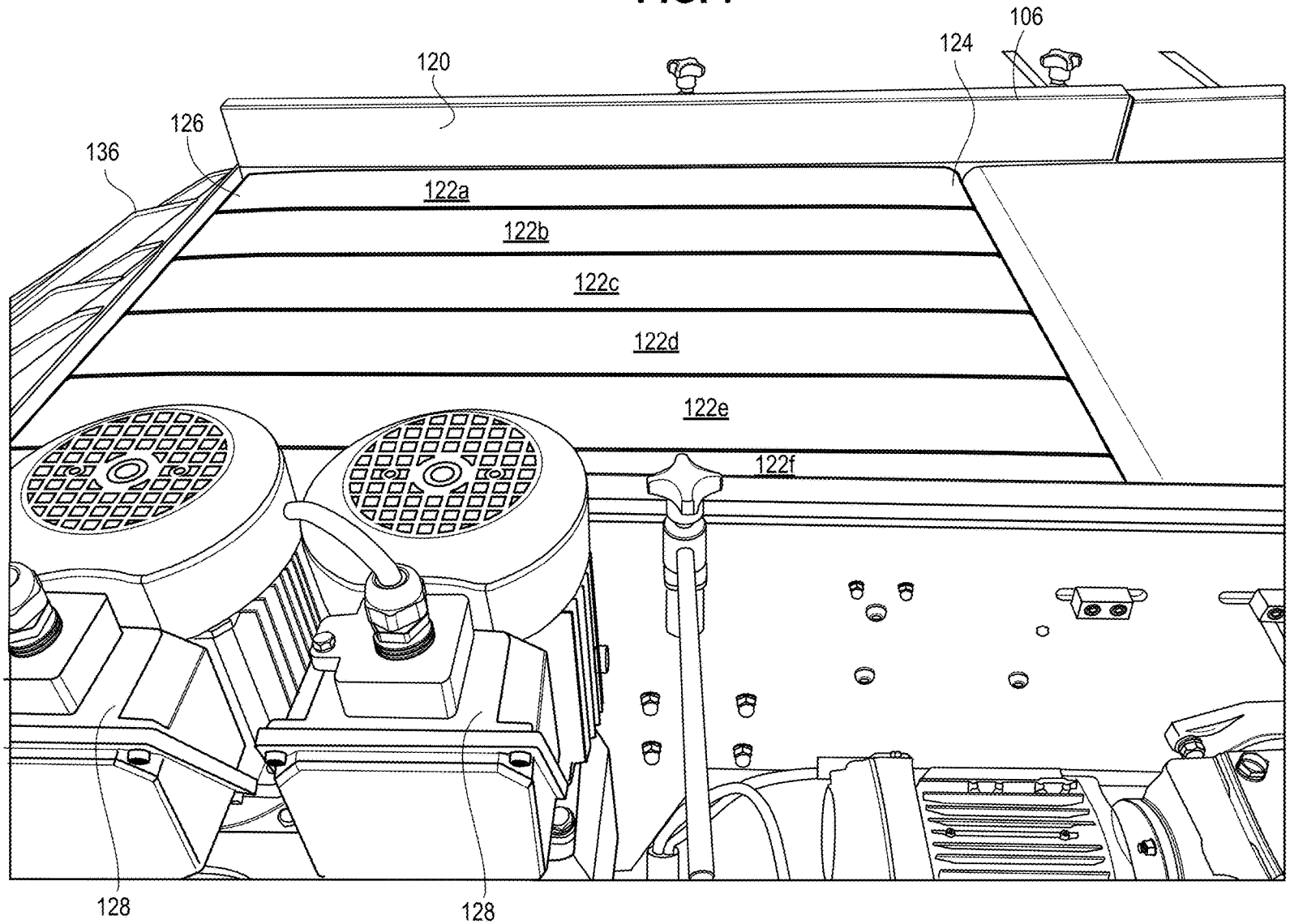
FIG. 7 shows a perspective view of an embodiment of a metering balancer station of the delivery system of FIG. 3.

As shown in FIGS. 8 and 9, right cylindrical metal guides 158*a-c*, central cylindrical metal guides 160*a-c*, and left cylindrical metal guides 162*a-c* are positioned above the top surface of the conveyor belt 150. Each of the metal guides 158, 160, and 162 is made of stainless steel, has a length of approximately 144 inches, and has a diameter of approximately 0.5 inches. As shown in FIGS. 6 and 7, the guides 158*c* and 160*a* define a right lane 164 and the guides 160*c* and 162*a* define a left lane 166 that receive the two lanes of sets of hot dog buns 130 from the metering balancer station 120 and the chute 136. Each of the right lane 164 and the left lane 166 has a width that is approximately the width of the food being delivered from the chute 136 and are aligned with the left and right lanes, respectively, of the chute 136. As with the chute 136, the width and number of lanes formed by the guides 160, 162, and 164 can be varied to approximate the size of the food being delivered by the metering balancer section 120. This is accomplished by moving the guides 158*a-c*, 160*a-c*, and 162*a-c* to positions so that lanes are formed for the bun feed grouper station 146 that correspond with and are aligned with the lanes of the chute 136.

As shown in FIG. 8, a digital camera 170 is positioned above the top surface of the conveyor belt 150 and located approximately 12 inches from the rear end 152 of the conveyor belt 150. Similarly, a second digital camera 172 is positioned above the top surface of the conveyor belt 150 and located approximately directly above the front end 154 of the conveyor belt 150. Note that other possible locations for the digital cameras 170 and 172 are possible as long as the digital cameras 170 and 172 are able to image the entire top surface of the conveyor belt 150. The digital cameras 170 and 172 take digital images of the sets of the hot dog buns 130 that are distributed along the entire length of the conveyor belt 150. Each camera is identical in structure. An example of a camera that can be used is the model CV-X322F camera manufactured and sold by Keyence.

The digital cameras 170 and 172 synchronously and simultaneously take digital color images of the sets of hot dog buns 130 on the top surface of the conveyor belt 150 and those portions of the top surface of the conveyor belt 150 that are not covered by the sets of hot dog buns 130. Each digital camera 170 and 172 independently takes a digital image of a portion of the entire top surface of the conveyor belt 150 and the sets of hot dog buns 130 positioned thereon, wherein when the images taken by the cameras 170 and 172 are combined they encompass the entire top surface of the conveyor belt 150. The period between consecutive digital images taken is at most 110 ms. Note that the use of two cameras 170 and 172 helps to ensure that the entire top surface of the conveyor belt 150 is digitally imaged and an adequate resolution for each digital image is achieved. Note that each of the digital cameras 170 and 172 has a processor that is programmed to discern the brown colors of the sets of hot dog buns 130 observable by the digital cameras 170 and 172 (cameras will see brown colors regardless of whether the sets of hot dog buns 130 are right-side up or upside down) while ignoring pixels associated with the conveyor belt 150. Obviously, it is preferable that the exterior surface of the conveyor belt 150 has a color, such as green, blue, or gray, that is easily discernable from the brown color of the sets of hot dog buns 130 on the top surface of the conveyor belt 150. For its corresponding digital image taken of the sets of hot dog buns 130, each camera 170 and 172 counts for each lane of the conveyor belt 150 the number of pixels along a longitudinal direction along the length of the conveyor belt 150 that have a brown value (either brown values typically seen for right-side up sets of hot dog buns 130 or lighter brown values typically see for upside-down sets of hot dog buns 130). The number of pixels is preferably taken along the middle of each set of hot dog buns 130. From the number of brown pixels in a particular longitudinal direction, the length of hot dog buns 130 along that particular longitudinal direction can be calculated. To do the calculation, it must be determined the linear size of a pixel. So, in the case that 100 brown colored pixels are counted along a longitudinal direction of a lane and it is known that each pixel represents a length of 0.12 inches, then the length of hot dogs in the lane is 12 inches (0.12 inches/pixel*100 pixels). Counting pixels and calculating lengths of hot dog buns in the other lanes of conveyor belt 150 are performed in a similar manner by the cameras 170 and 172. Note that while the counting of pixels and the calculation of lengths of buns is performed by the cameras 170 and 172 for delivery system 100, it is possible to have digital color cameras send the pixel information of their digital images to a programmable logic controller (PLC) 174, which performs the counting and calculation of hot dog lengths in each lane as mentioned previously.

In an alternative way to analyze the digital image of the cameras 170 and 172, the cameras 170 and 172 or the PLC 174 can calculate the number of hot dog buns in each lane. For example, the number, N, of hot dog buns along a particular longitudinal direction of a lane will be equal to the number, P, of pixels counted along the longitudinal direction times the length, $L_p$, of a pixel in inches and then divided by the length, $L_b$, of a single hot dog bun–$N=P*L_p/L_b$, wherein $L_b$ typically has a value of 6 inches.

This calculation is performed for each lane and performed for one particular longitudinal direction for each lane. In the case of single hot dog buns, the calculation gives the number of single hot dog buns 130 in a particular lane. For sets of hot dog buns that are in a 2×2 pattern, the number of sets of hot dog buns 130 in a lane is equal to N/2, since there are two hot dog buns along the longitudinal direction for each set of hot dog buns. Thus, for each lane, the number of single hot dog buns or sets of hot dog buns can be calculated.

Once the length or number of single hot dog buns 130 or sets of hot dog buns 130 present in each lane is calculated by the cameras 170 and 172 per the processes discussed previously, balancing of the hot dog buns 130 on the conveyor 150 can be accomplished. Balancing can be understood by reviewing the distribution of single hot dog buns 130 on conveyor 150 at various points in time as shown in FIGS. 5A-D. In particular, FIG. 5A shows a point in time when hot dog buns 130 have been fed from conveyor belts 122*a-f* of metering balancer station 120 to chute 136 and to conveyor belt 150. The hot dog buns 130 are jumbled and randomly distributed in the balancer station 120. The hot dog buns 130 are directed to one of 8 lanes by chute 136 and so the hot dog buns 130 become more ordered in their distribution by the chute 136 onto the rear end of the conveyor belt 150. At the front end of the conveyor belt 150, the hot dog buns 130 congregate with each other at the gates 202 associated with each lane and that are in an up position. As shown in FIG. 5A, there are 8 hot dog buns 130 in the bottom lane A of conveyor belt 150. Lanes B-H have S, 5, 5, 5, 4, 5, and 4 hot dog buns, respectively. Thus, lane A has more hot dog buns 130 than the other lanes and there is a need to find a way to reduce the number of hot dog buns 130 in lane A while increasing hot dog buns in lane F and, thus, trying to even out the number of hot dog buns 130 in each lane. In response to the imbalance, hot dog buns 130 are delivered to lanes C-H and not lanes A-B by balancer station 120 and chute 136 and gates 202 for lanes A, C-E, and G are lowered allowing hot dog buns 130 to enter the balancer station 204, as shown in FIG. 5B. The hot dog buns 130 in balancer station 204 are allowed to remain in their lane and move on to the next station. As shown in the subsequent snapshot of FIG. 5C, the hot dog buns 130 on the conveyor belt 150 have moved further towards the gates 202 that have not changed their positions shown in FIG. 5B. Thus, the hot dog buns 130 in lanes A, E, and G are moved into the balancer station 204. In contrast to the situation of FIG. B, the three hot dog buns 130 in lanes A, E, and G of the balancer station 204 are shifted one lane to their left to lanes B, F, and H, as shown in FIG. 5D. This results in the number of hot dog buns 130 in lane A (and lanes E and G) being reduced and the number of hot dog buns 130 in lane F (and lanes B and H) being increased, which was desired in the point of time represented by FIG. 5A. Of course, with the shifting of hot dog buns 130 there may be a need to balance lanes B, E, G, and H. This balancing process is ongoing from time to time and will be discussed in more detail hereinafter.

So, the question is when is a lane of conveyor belt 150 deemed sufficiently filled so that balancing of that lane is not a priority? A lane is deemed to be sufficiently filled when the total length of food items in the lane determined by the cameras 170 and 172 is at least a threshold value equal to 1.5*typical length of a single product being photographed (in the example of FIGS. 5A-5D, the typical length of a single hot dog bun is approximately 6 inches and so the threshold value is 9 inches). When a lane is below the threshold value, that indicates the lane needs additional food product. Note that if a lane has a total length of food product determined by cameras 170, 172 that reaches a value that is at least a second threshold value of 11*length of product, then that indicates that the lane is too full with product.

With the above summary of the balancing process to be performed at conveyor belt 150 in mind, balancing of the conveyor belt 150 shown in FIGS. 8 and 9 will be described hereafter. As described previously, the conveyor belt 150 and the guides 158, 160, and 162 define a right lane 164 and a left lane 166 to receive sets of hot dog buns 130 that define a 4 by 1 grouping of hot dog buns 130. The distribution of the sets of hot dog buns 130 is accomplished by the metering balancer station 120 and a lane balancer station 204.

As explained previously, the metering balancer station 120 has six independently controlled plastic conveyor belts 122*a-f*. The metering balancer station 120 can perform either coarse or fine balancing functions for the conveyor belt 150. In the case of coarse balancing, the conveyor belts 122*a-f* will each move in unison with each other at a speed that ranges from 10 ft/min to 30 ft/min when each of the lanes has a total length of product in its lane as determined by cameras 170 and 172 that is below the second threshold value associated with a 4 by 1 set of hot dog buns 130. Such movement in unison provides some balancing for the conveyor belt 150 in view of the random nature of the distribution of sets of hot dog buns 130 and the funneling effect of the chute 136. Should the cameras 170 and 172 determine that total length value for the sets of hot dog buns 130 on the conveyor belt for either lane is at least the second threshold value, then all of the conveyor belts 122*a-f* associated with the lane that is at least the second threshold value are either stopped or reversed in direction so that no additional sets of hot dog buns 130 are supplied to the lane in question for the conveyor belt 150.

Fine balancing by the metering balancer station 120 is accomplished by controlling each conveyor belt 122*a-f* based on the total length value for the sets of hot dog buns 130 measured in each lane 164 and 166 by the cameras 170 and 172. For examples, if the cameras 170 and 172 indicate that the right lane 164 has a total length value that is at least the first threshold value and is below the second threshold value, then that indicates that the lane is sufficiently filled with sets of hot dog buns 130 for further processing by the delivery system 100. In that case, the programmable logic controller (PLC) 174 previously mentioned receives signals from the cameras 170, 172 indicative of the total length value and the PLC 174 determines that the first threshold value is met and the second threshold value is not met and consequently does not change the speeds and directions of the left-most plastic conveyor belts 122*a-c*. Similarly, if the total length value for the left lane 166 is at least the first threshold value, then that indicates that the lane 166 is sufficiently filled with sets of hot dog buns 130 for further processing by the delivery system 100. In that case, the PLC 174 does not change the speeds and directions of the right-most plastic conveyor belts 122*d-f*. Note that if the total length value for the right lane 164 and/or the left lane 166 reaches the second threshold value, then that signals that the lane(s) that reaches the second threshold value is too full with product, such as the sets of hot dog buns 130. For a lane that reaches the second threshold value, the PLC 174 will direct the conveyor belts 122*a-f* to either stop or reverse their direction so that the sets of hot dog buns 130 on the conveyor belts 108, 110, 122, and 150 can be manually rearranged so the lane(s) is not too full.

If the PLC 174 determines that the total length value for either or both lanes 164 and 166 sent to it by the cameras 170 and 172 is less than the first threshold value, that indicates that the lane in question is not sufficiently filled with sets of hot dog buns 130. In this situation, the PLC 174 will balance one or more lanes by continuously adjusting the speeds and directions of the plastic conveyor belts 122*a-f* associated with the lane(s) that need more sets of hot dog buns 130 so as to provide more sets of hot dog buns to particular ones of the lane(s) in an efficient manner so that each lane is sufficiently filled (i.e., each lane of the conveyor belt 150 has a total length value of at least the first threshold value mentioned previously). As mentioned previously, FIGS. SA-SD give an example of balancing of single hot dog buns on the conveyor belt 150. As can be seen in FIG. 5A, the conveyor belt 150 initially has more buns in lane A and the least in lanes F and H. The cameras 170 and 172 recognize this imbalance and sends signals to the PLC 174 which results in the conveyor belts 122*a-h* of meter balancing station 120 being controlled so that more hot dog buns are delivered to lanes of the metering balancer station 120 corresponding to lanes F and H of conveyor belt 150 than in lanes of metering balancer station 120 corresponding to lane A of conveyor belt 150. Accordingly, when the buns from metering balancing station 120 reach the buns on conveyor belt 150, there will approximately the same number of buns in each lane of conveyor belt 150. Note that while the balancing principles described with respect to FIGS. 5A-5D regards single hot dog buns, such balancing principles can be applied when there are single hamburger buns or sets of hot dog buns or hamburger buns.

Balancing of the sets of hot dog buns 130 on the conveyor belt 150 is performed by both the metering balancer station 120 and the lane balancer station 204 that work in conjunction with one another via PLC 174. Note that the above balancing process performed by the metering balancer station 120 and the lane balancer station 120 is a real-time and continuous process in that while the pictures are being taken and processed, the moving conveyor belts 122*a-f*, 180, and 208 are controlled by the PLC 174. Explanation of the operation of the lane balancer station 204 and the conveyor belts 180 and 208 will be explained later in this description. PLC 174 can also control the speed and direction of hot dog buns 130 to an orientation system 175 to be described hereinafter.

As shown in FIGS. 4 and 10-12, sets of hot dog buns 130 at the front end 154 of the conveyor belt 150 are transferred to the orientation system 175 that includes a holding conveyor station 176, a lane balancer station 204, a turning station 226, and a flipping station 236 that are in series with one another. The holding conveyor station 176 includes a conveyor 178 with conveyor belt 180 that a width of approximately 31 inches and a length of approximately 36 inches. The conveyor belt 180 is available from Intralox Co. The conveyor belt 180 is looped and has a rear end 182 that receives a roller (not shown) that engages the interior surface of the conveyor belt 180 in a well-known manner. The front end 184 of the conveyor belt 180 receives a drive roller (not shown) that engages the interior surface of the conveyor belt 180. The distance between the roller and the drive roller is approximately 8 inches (4 inches back and 4 inches down). The drive roller is rotated by a motor (not shown), which results in the drive roller moving the conveyor belt 180 about the roller at the rear end 182. The speed of the conveyor belt 180 is in the range of 30 ft/min to 70 ft/min.

Figure 10:
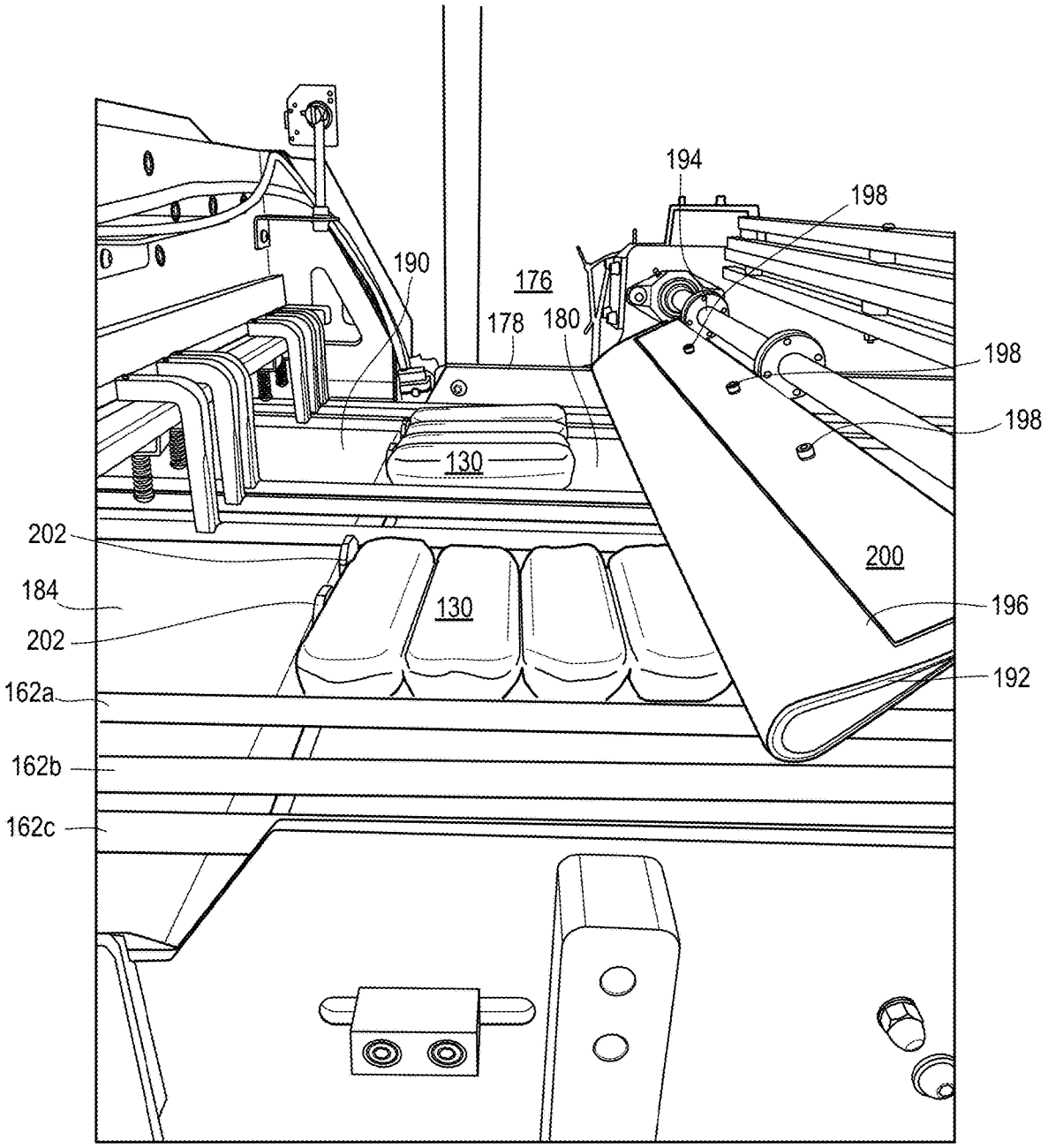
FIG. 10 shows a perspective view of an embodiment of a holding conveyor station of the delivery system of FIG. 3.
Figure 11:
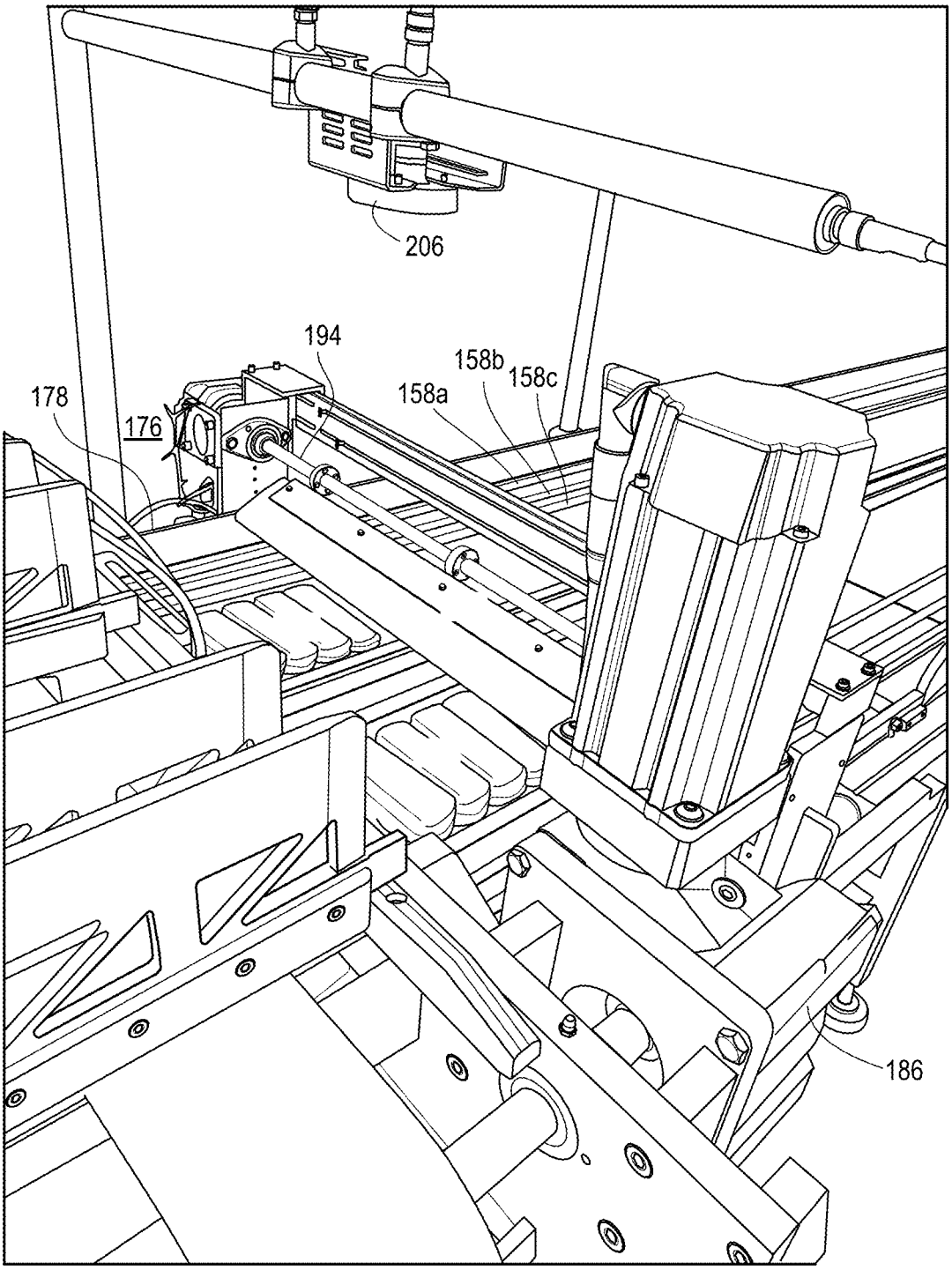
FIG. 11 shows a second perspective view of the holding conveyor station of FIG. 10.
Figure 12:
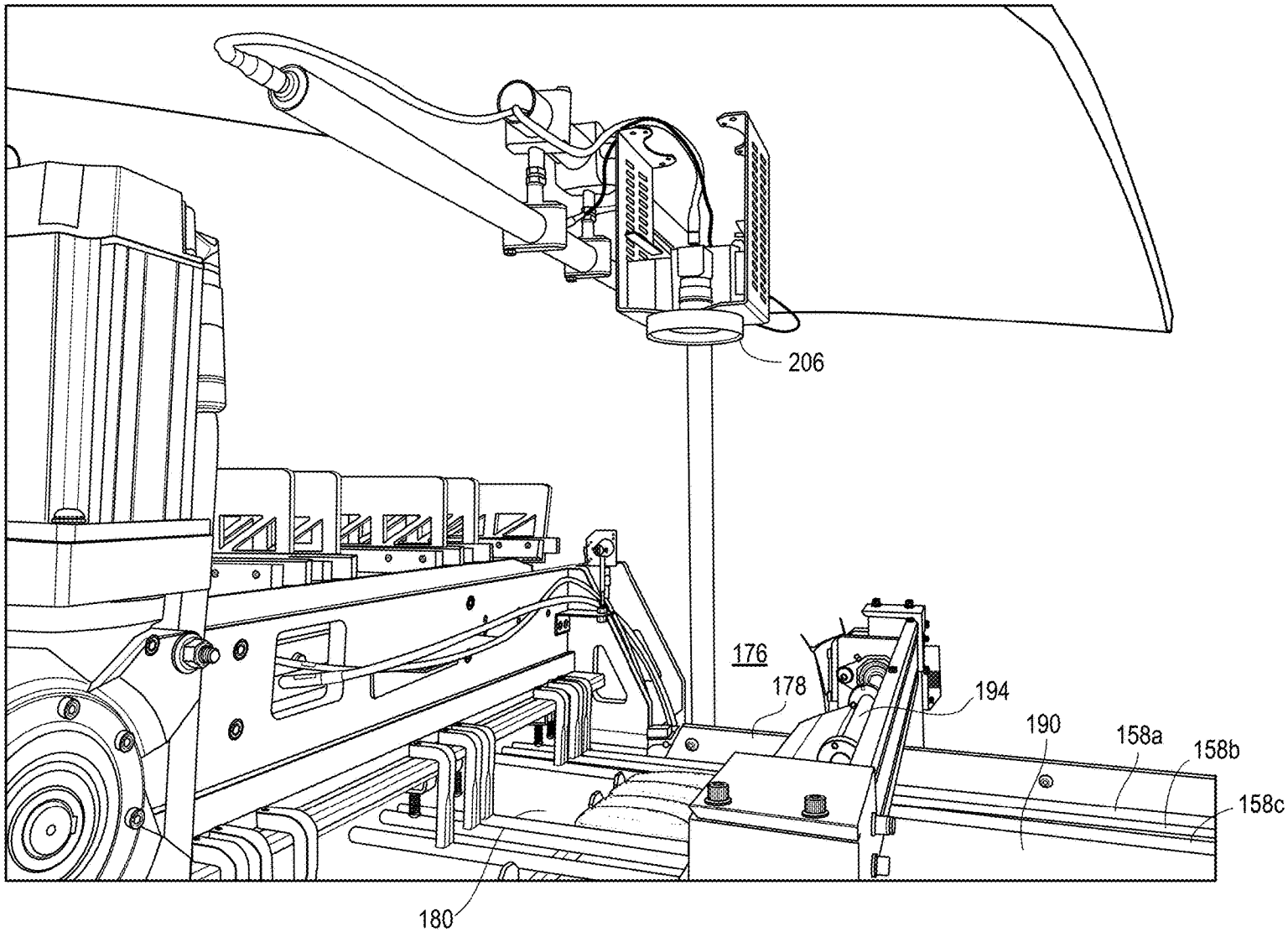
FIG. 12 shows a third perspective view of the holding conveyor station of FIG. 10.

As shown in FIGS. 10-12, the right cylindrical metal guides 158*a-c*, central cylindrical metal guides 160*a-c*, and left cylindrical metal guides 162*a-c* are positioned above the top surface of the conveyor belt 180. Accordingly, the guides 158, 160, and 162 define a left lane 188 and a right lane 190 in which the sets of hot dog buns travel. As shown in FIGS. 10-12, the holding conveyor station 176 includes a holding mat 192 that is supported above the lanes by a rotatable shaft 194. The holding mat 192 has a mat 196 folded upon itself, wherein the front and back edges contact one another and are attached to one another by bolts 198 of a metal flange 200. The metal flange 200 is attached to the rotatable shaft 194. The function of the holding mat 192 will be discussed later.

Just past the front end 184 of the conveyor belt 180 are a plurality of movable gates 202 (one per lane for single hot dog buns and single hamburger buns and up to twelve in number if twelve lanes are present for single buns; two per lane for sets of hot dog buns (see FIG. 10) and sets of hamburger buns) that when in an up position prevent sets of hot dog buns 130 from moving past the conveyor belt 180 to the lane balancer station 204 to be discussed hereafter. As shown in FIG. 10, each gate 202 is made of metal, has a square-like body, and has a rounded top surface. When the movable gates 202 are in a down position, the sets of hot dog buns 130 are allowed to pass to the lane balancer station 200. Operation of the gates 202 will be discussed hereafter. Note that the conveyor belt 180 is moving at a constant speed during the processes mentioned above.

As shown in FIGS. 5H, 5I, 11, and 12, a digital camera 206 is positioned above the top surface of the conveyor belt 180 and located above and just before the gates 202. The digital camera 206 is similar to the digital cameras 170 and 172 discussed previously, but regards model C8-200C made by Keyence, which has a different mode high speed lens and is able to break up the image into four measurement zones, wherein the number of measurement zones depends on the type of product being imaged. The ability to analyze four measurement zones allows for detection of misalignment of partial sets of hot dog buns 130 while in the holding conveyor station 176. In operation, the digital camera 206 generates digital images of a target area of the top surface of conveyor belt 180 located between the holding mat 192 and the lane balancer station 204 and any sets of hot dog buns 130 lying in the target area. The digital camera 206 is programmed to analyze each of the measurement zones and perform the following measurements and calculations: 1) measure presence of a set of hot dog buns in a lane of the target area; 2) measure the color of a set of hot dog buns to be used for determining whether the set of hot dog buns is right-side up or upside down; 3) calculate whether a portion of the set of hot dog buns 130 is missing or misshaped; and 4) calculate orientation of the set of hot dog buns 130.

Figure 1B:
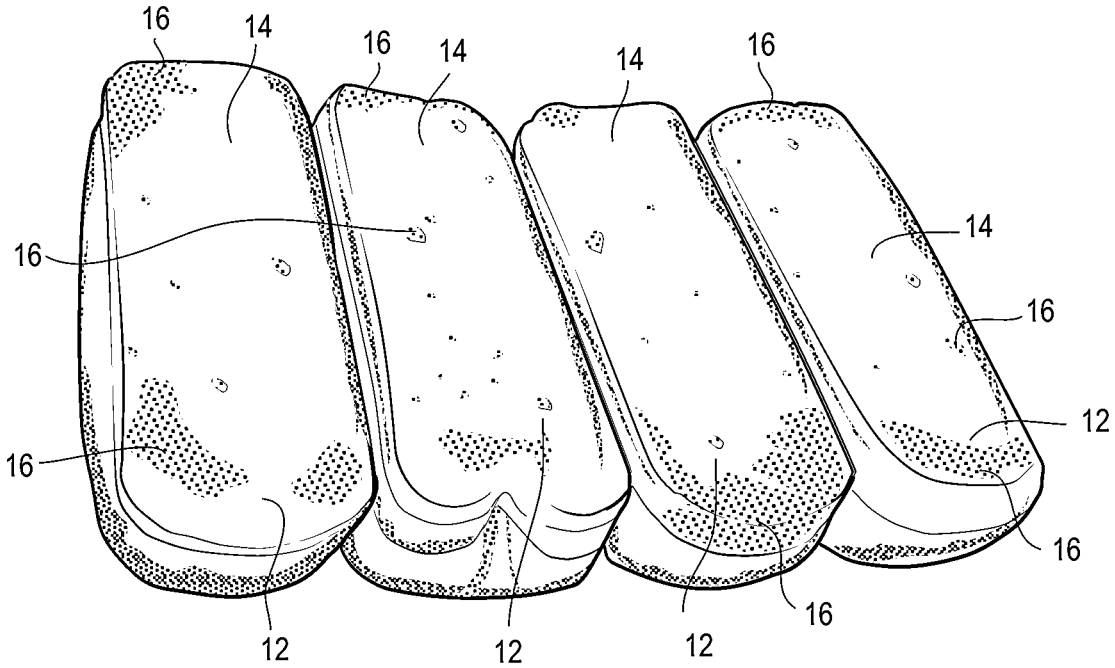
FIG. 1B shows a bottom perspective view of the bottoms of typical hot dog buns.

One thing the digital camera 206 does with the digital images is to determine whether sets of hot dog buns 130 exist in any of the lanes of the target area. Such a determination is done by measuring the color value a pixel in the middle of a lane and near the gate(s) 202 associated with the lane. If the value of the color of the pixel is a brown value found on either a bottom 14 (see FIG. 1B) or a top (see FIG. 1A) of a set of hot dog buns 130, then that indicates that a set of hot dog buns 130 is present in the lane and adjacent to the gate(s) 202 associated with the lane. This measurement process is performed by the camera 206 for each lane of the target area. Note that when a set of hot dog buns 130 is determined to be in the lane, the camera 206 associates a unique tag/identification with that set of hot dog buns 130.

After the digital camera 206 determines the presence of a set of hot dog buns 130 in a lane and associates a unique tag/identification with that set of hot dog buns 130, the digital camera 206 determines from the pixels of the image of the set of hot dog buns 130 whether the surface of the set of hot dog buns 130 facing the digital camera 206 has the white patches 16 and/or lighter brown color discussed previously with respect to FIG. 1B. In particular, the digital camera 206 looks at a color value of a pixel located at the center of the set of hot dog buns 130 and determines whether the side of the set of hot dog buns 130 facing the digital camera 206 is right-side up or upside down by comparing the color values of the side being examined with the known color values for a side being right-side up. If the color values of the side are sufficiently different than the known color values, then the set of hot dog buns 130 being analyzed is denoted to be upside down. Otherwise, the set of hot dog buns 130 is denoted to be right-side up. The above analysis takes into account that either side of the set of hot dog buns 130 will have brown color values, wherein there are a range of brown colors from a first threshold value to below a second threshold value that are the light brown colors of a bottom of the set of hot dog buns 130. Brown values at or above the second threshold value are the darker brown colors of a top of the set of hot dog buns 130. Thus, if a color pixel has a value at or above the first threshold value and below the second threshold, then detection of that color pixel denotes that camera 206 is facing an upside-down set of hot dog buns 130. Similarly, if a color pixel has a brown value at or above the second threshold value, then detection of that color pixel denotes that camera 206 is facing a right-side up set of hot dog buns 130. During this process, the camera 206 assigns a flag to the previously described unique tag or identifier associated with the set of hot dog buns 130, wherein the flag indicates whether the corresponding set of hot dog buns is right-side up or upside down. Such information is sent to the PLC 174.

Besides determining which ones of the sets of hot dog buns 130 are upside down, the digital camera 206 processes the digital image of the sets of hot dog buns 130 within the target area to see whether there are any sets of the hot dog buns 130 that are missing one or more hot dog buns or have a damaged hot dog bun. In this case, the digital camera 206 counts for each set of hot dog buns 130 the number of pixels that have a color value that is different from the color value of the conveyor belt 180 of the target area (such as the brown pixel values of the imaged right-side up hot dog buns and the lighter brown pixel values and white pixel values of the imaged upside-down hot dog buns). Each pixel defines an area and so the count of color values is calculated by the digital camera 206 to be the area of the set of hot dog buns 130 being imaged. If the calculated area is less than 80% of the average surface area of a top or bottom portion of complete set of hot dog buns 130, then the digital camera 206 designates the set of hot dog buns 130 as not acceptable for packaging (it is missing one or more hot dog buns and/or one or more hot dog buns are misshapen). During this process, the digital camera 206 assigns to each unique tag or identifier for each set of hot dog buns 130 a flag indicating whether or not the set of hot dog buns 130 is acceptable for packaging. Such information is sent to the PLC 174.

Figure 2:
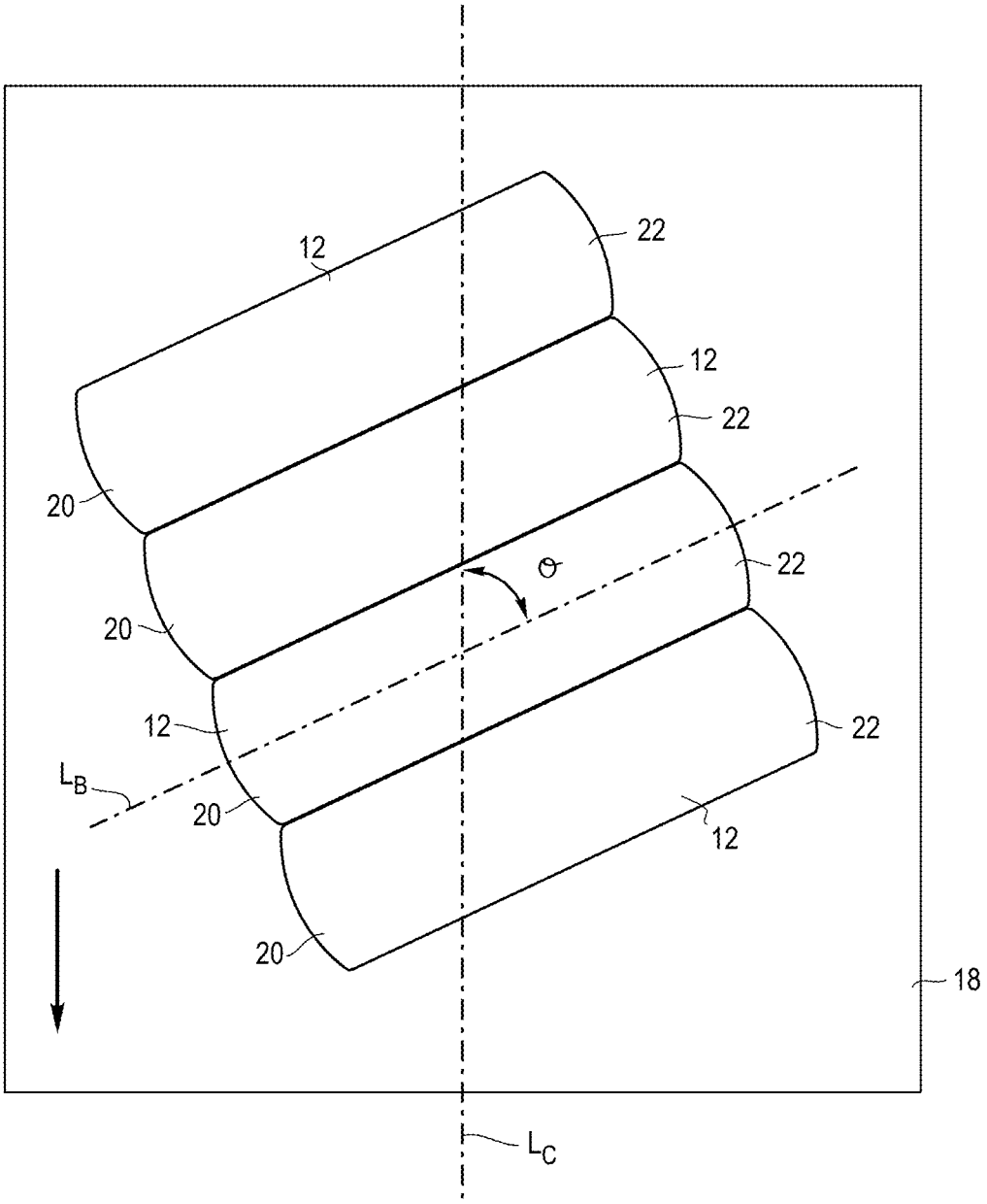
FIG. 2 schematically shows the orientation of a set of four hot dog buns relative to an axis of a conveyor.

The digital camera 206 also processes the digital image of the target area to determine whether each set of hot dog buns 130 is properly oriented to have an angle θ of approximately 0°, such as ±1° to 2° as defined previously with respect to FIG. 2. In particular, for each detected set of hot dog buns 130, the digital camera 206 calculates an angle between a longitudinal axis of the lane in which set of hot dog buns 130 lies and longitudinal axis defined by pixels of a hot dog bun of the set of hot dog buns 130. If the digital camera 206 determines that a set of hot dog buns 130 is not properly aligned, then the digital camera 206 will designate the set of hot dog buns 130 as not being properly oriented. It is believed that most sets of hot dog buns 130 that are identified as not being properly oriented will have an angle θ of approximately 90°. Note that the above-described determination of orientation is not performed for single hot dog buns and symmetric groups of buns (2×2, 3×3, etc.) since the guides 158, 160, 162 help to align such hot dog buns in a proper orientation. During this process, the digital camera 206 assigns to each unique tag or identifier for each set of hot dog buns 130 a flag indicating whether or not the set of hot dog buns 130 is properly oriented. Such information is sent to the PLC 174.

Besides each of the sets of hot dog buns 130 within the target area being categorized by the digital camera 206 as to whether it is: 1) present; 2) upside down; 3) unacceptable for packaging; and 4) oriented properly, each set of hot dog buns 130 in the target area is identified whether or not it is in a lane that needs to be balanced by the lane balancer station 204. As mentioned previously with respect to FIGS. 5A-D, such balancing pertains to the distribution of sets of hot dog buns 130 present on the conveyor belt 150. The lane balancer station 204 performs balancing in addition to the balancing performed by the metering balancer station 120 by either 1) allowing sets of hotdog buns 130 in the lanes of the target area and at the gates 202 to continue in those lanes on to the turning station 226 to be described hereinafter or 2) be shifted one or more lanes and passed on to the turning station 226.

Delivery of the sets of hot dog buns 130 from the target area of the holding conveyor station 176 to the lane balancer station 204 is performed as follows. First, if any lanes of the target area contain sets of hot dog buns 130 adjacent to the gates 202 that have been identified not acceptable for packaging, the gates 202 for those lanes are lowered and the unacceptable sets of hot dog buns 130 in those lanes and adjacent to the gates 202 are fed into and processed by the lane balancer station 204 as described hereinafter. After the unacceptable sets of hot dog buns 130 enter the lane balancer station 204, the lowered gates 202 are raised to their up position.

After the unacceptable sets of hot dog buns 130 are processed by the lane balancer station 204, then for those sets of hot dog buns 130 at the gates 202 that are determined to accomplish balancing of sets of hot dog buns 130 by staying in their lanes, their corresponding gates 202 are lowered and the paddles 216 of the lane balancer station 204 are kept stationary so that the sets of hot dog buns 130 pass between the paddles 216 and are delivered to the turning station 226. After the sets of hot dog buns 130 pass the lowered gates 202, the gates 202 are raised to their up position.

For those sets of hot dog buns 130 at the gates 202 that are determined to accomplish balancing of sets of hot dog buns 130 by changing their lanes, their corresponding gates 202 are lowered, the sets of hot dog buns 130 travel past the gates 202 and between the paddles 216 of the lane balancer station 204, and the paddles 216 move so as to move the sets of hot dog buns 130 positioned between the paddles 216 to their new lanes. After the sets of hot dog buns 130 pass the lowered gates 202, the gates 202 are raised to their up position. Note that should there be sets of hot dog buns 130 at the gates 202 that need to stay in their lane for the sake of balancing and there are other sets of hot dog buns 130 at the gates 202 that need to shift lanes for the sake of balancing, the PLC 174 will determine which gates 202 are lowered and raised in order to achieve balancing of the sets of hot dog buns 130 on the conveyor 150.

FIG. 5E schematically illustrates a way of determining how to balance the conveyor 150 by using the lane balancer station 204. In the case of FIG. 5E, single hot dog buns are being processed and there are 12 lanes on the conveyor 150. FIG. 5E shows the total length value for each lane as calculated by the cameras 170 and 172. When there is a lane present that has a total length value that is 1.5 times the length of a single hot dog bun or less, then balancing of that lane is required to be performed by the lane balancer station 204. The lanes with the largest and smallest total length values are identified (Jane 10 largest and lane 11 smallest) so as to identify primary tasks to be accomplished by balancing (decrease the length of the lane with the largest length value and increase the length of the lane with the smallest length value by receiving length from the lane with the largest length value). Balancing will be accomplished by shifting hot dog buns from large total length values to small total length values so that over several cycles of lower and raising of the gates 202, the total length values in each lane are similar in value. While it would be possible to shift hot dog buns from lane 1 to lane 11, such shifting is not optimal since it would lead to a large amount of time to shift the paddles 216 from lane 1 to lane 11. In this example, it would be more time efficient to shift hot dog buns from lane 10 to lane 11. Other possible lane shifts would be to shift hot dog buns from lanes 4, 8, and 10 to lanes 5, 9, and 11, respectively. Since such lane shifts are only one lane in magnitude, the balancing process is much more time efficient. The cameras 170 and 172 continuously calculate and monitor the total length values for each lane and the PLC 174 controls the gates 202 and lane balancer station 204 in order to define optimum moves to achieve balancing of the hot dog buns on the conveyor belt 150 without minimizing cycle times of the balancing process.

The balancing performed by the lane balancer station 204 can be understood by reviewing the balancing process schematically shown in FIGS. 5F and 5G for single hot dog buns. In the first phase (labeled Groups 1), there are 9, 7, 7, 5, 7, 7, 7, and 7 single buns in lanes 1-8, respectively. The gates for lanes 1 and 5-8 are lowered allowing single buns (denoted A) at the gates to move to the lane balancer station 204. Once the single buns for lanes 1 and 5-8 pass the gates, the gates for lanes 1 and 5-8 are raised to the up position. Single buns (denoted B) are directed to the gates 1-3 and the first phase of the balancing process is complete, wherein there are now 8, 7, 7, 5, 6, 6, 6, and 6 single buns in lanes 1-8, respectively.

In the second phase of balancing, gates 1-3 are lowered and gates 4-8 are maintained in the up position. During this process, the single buns in lanes 1 and 5-8 of the lane balancer station 204 pass through the lane balancer station 204 without being shifted to another lane. In addition, the single buns from gates 1-3 move to lanes 1-3 of the lane balancer station 204 and are each shifted one lane to lanes 2-4. Once the single buns for lanes 1-3 pass the gates, the gates for lanes 1-3 are raised to the up position. Single buns are directed to the gates 1 and 5-8 and the second phase of the balancing process is complete, wherein there are now 7, 6, 6, 5, 6, 6, 6, and 6 single buns in lanes 1-8, respectively. Since the numbers in the lanes are not equal, further balancing is needed.

As shown in FIG. 5F, the above two phases are repeated (labeled Groups 2). In the third phase, there are 7, 6, 6, 5, 6, 6, 6, and 6 single buns in lanes 1-8, respectively. The gates for lanes 1 and 5-8 are lowered allowing single buns (denoted A) at the gates to move to the lane balancer station 204. Once the single buns for lanes 1 and 5-8 pass the gates, the gates for lanes 1 and 5-8 are raised to the up position. Single buns (denoted B) are directed to the gates 1-3 and the third phase of the balancing process is complete, wherein there are now 6, 6, 6, 5, 5, 5, 5, and 5 single buns in lanes 1-8, respectively. Since the number of buns in each lane are still unequal, further balancing is required.

In the fourth phase of balancing, gates 1-3 are lowered and gates 4-8 are maintained in the up position. During this process, the single buns in lanes 1 and 5-8 of the lane balancer station 204 pass through the lane balancer station 204 without being shifted to another lane. In addition, the single buns from gates 1-3 move to lanes 1-3 of the lane balancer station 204 and are each shifted one lane to lanes 2-4. Once the single buns for lanes 1-3 pass the gates, the gates for lanes 1-3 are raised to the up position. Single buns are directed to the gates 1-8 and the fourth phase of the balancing process is complete, wherein there are now 5, 5, 5, 5, 5, 5, 5, and 5 single buns in lanes 1-8, respectively. With equal numbers of single buns in each lane, the conveyor belt 150 is balanced. In addition, two groups of single buns for lanes 1-8 are directed to the bagger.

As shown in FIGS. 5F and 5G, phases 5-9 (denoted Groups 3-7 in the figures) are performed, wherein each phase entails lowering the gates at lanes 1-8 and having the single buns in lanes 1-8 pass through the lane balancer station 204 without being shifted in their lanes by the lane balancer station 204 and passing on to the bagger since the number of single buns in each lane are equal at the start of the phase. After the single buns pass through the gates, the gates are received and single buns line up in lanes 1-8 and signaling the end of phase 5. The above described phase 5 is repeated four more times as shown in FIGS. 5F-G and resulting in one bun—being in each of lanes 1-8. Note that during the above balancing processes, the cameras 170 and 172 are continually monitoring the food items on the conveyor belt 150 to see whether the numbers in each lane become unequal and so balancing is required by lane balancer station 204.

Figure 13:
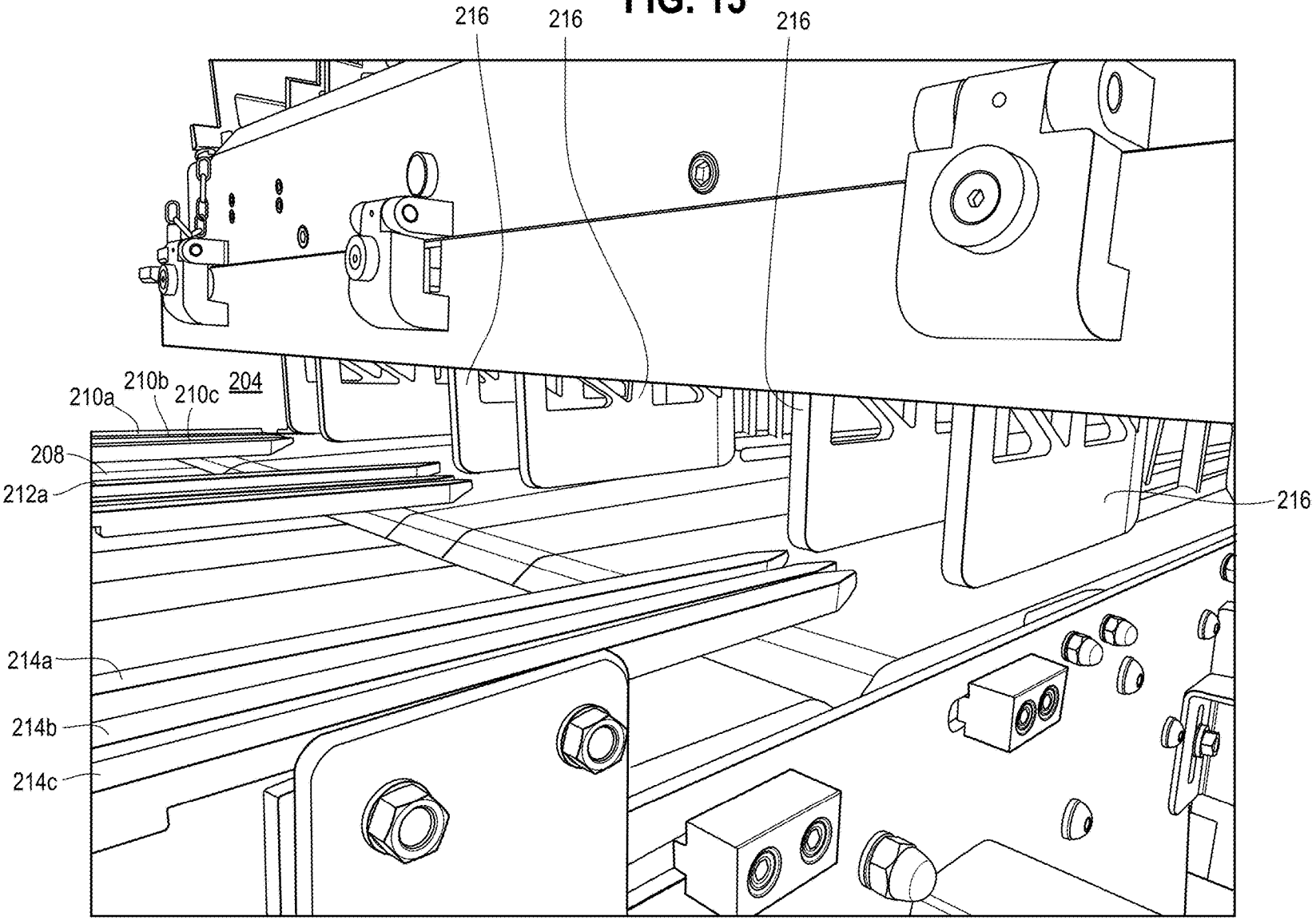
FIG. 13 shows a perspective view of an embodiment of a lane balancer station of the delivery system of FIG. 3.

As shown in FIG. 13, the lane balancer station 204 includes a conveyor belt 208 similar to conveyor belt 180 described previously. Note that when balancing is performed by the lane balancer station 204, the conveyor belt 208 is slowed down so that lane changing is achieved. For a portion of the conveyor belt 208, there are no guides present. At the rear portion of the conveyor belt 208, right metal guides 210*a-c*, central metal guides 212*a-c*, and left metal guides 214*a-c* are positioned above the top surface of the conveyor belt 208. The right metal guides 210*a-c*, the central metal guides 212*a-c*, and the left metal guides 214*a-c* are generally aligned with right guides 158*a-c*, central guides 160*a-c*, and left guides 162*a-c*, respectively, so that they define lanes. As shown in FIG. 13, there is a gap formed on the conveyor belt 208 between the right guides 158 and 210, the central guides 160 and 212, and the left guides 162 and 214. In this gap are positioned paddles 216 that are made of Acetal and grouped in pairs. For each pair of paddles 216 and in the case that the food being packaged is the set of hot dog buns 130, the paddles 216 are separated from one another by approximately 12 inches for sets of hot dog buns 130 as measured along a direction perpendicular to the direction of travel of the conveyor belt 208. In addition, adjacent pairs of paddles 216 are separated from one another by a distance of approximately 9 inches, wherein the distance is the distance between the paddles 216 of the adjacent pairs that are nearest to one another and as measured along the direction perpendicular to the direction of travel of the conveyor belt 208. The distance between adjacent pairs of paddles 216 allows for a set of hot dog buns 130 to be positioned therebetween. The pairs of paddles 216 are arranged on a conveyor 218 that is positioned above the conveyor belt 208 and move left or right along a direction perpendicular to the direction of travel of the conveyor belt 208. The conveyor is 218 is controlled by a servo motor 186, which is controlled by the PLC 174. The PLC 174 and the servo motor 186 are able to rotate the conveyor 218 such that the pairs of paddles 216 are positioned at the correct place above the conveyor belt 208 at the correct time.

Note that in the case of other foods being packaged, such as single hot dog buns, or sets of hot dog buns with 2 or 3 buns, or single hamburger buns, or sets of hamburger buns with 2, 3, or 4 hamburger buns, the separation between the paddles 216 of a pair of paddles and distance between the adjacent pairs of paddles are varied dependent on the size of the food being packaged. Adjustment of such separation and distance is accomplished by removing paddles or inserting paddles to accomplish the desired separation and distance for all pairs of paddles.

As discussed previously, lanes of sets of hot dog buns 130 enter the lane balancer station 204 from the gates 202 to be processed. After the lanes of sets of hot dog buns 130 are processed by the lane balancer station 204, the sets are moved to the turning station 226 and then the next lanes of sets of hot dog buns 130 are delivered to and processed by the lane balancer station 204. As shown in FIGS. 5A-5D, 5F-5G, gates 202 are being raised and lowered so as to selectively allow sets of hot dog buns 130 to be processed by the lane balancer station 204 as discussed below. Note that when the gates 202 are raised the holding mat 192 is rotated to a raised position so as to allow sets of hot dog buns 130 to enter the target area so that they can be analyzed and tagged by camera 206 in the manner described previously. In this situation, the PLC 174 will rotate the holding mat 192 to a lower position after sets of hot dog buns 130 have entered the target area which causes the bolding mat 192 to trap the sets of hot dog buns 130 in the target area. The above process will repeat after gates 202 are raised for the next time. Note the conveyor belt 180 is always running at a constant speed while the previously described processes within the holding conveyor station 176 are performed.

For the sets of hot dog buns 130 that are at the lane balancer station 204 and within the gap between the left guides 158 and 210, the central guides 160 and 212, and the right guides 162 and 214, the sets of hot dog buns 130 designated as being unacceptable for packaging are removed by the lane balancer station 204. In particular, the paddles 216 of the lane balancer station 204 are moved quickly to the right so that the unacceptable sets of hot dog buns 130 located between paddles 216 are moved out of the lane and the machine and into a storage bin (not shown) for reuse and/or a refuse/trash bin.

Figure 14:
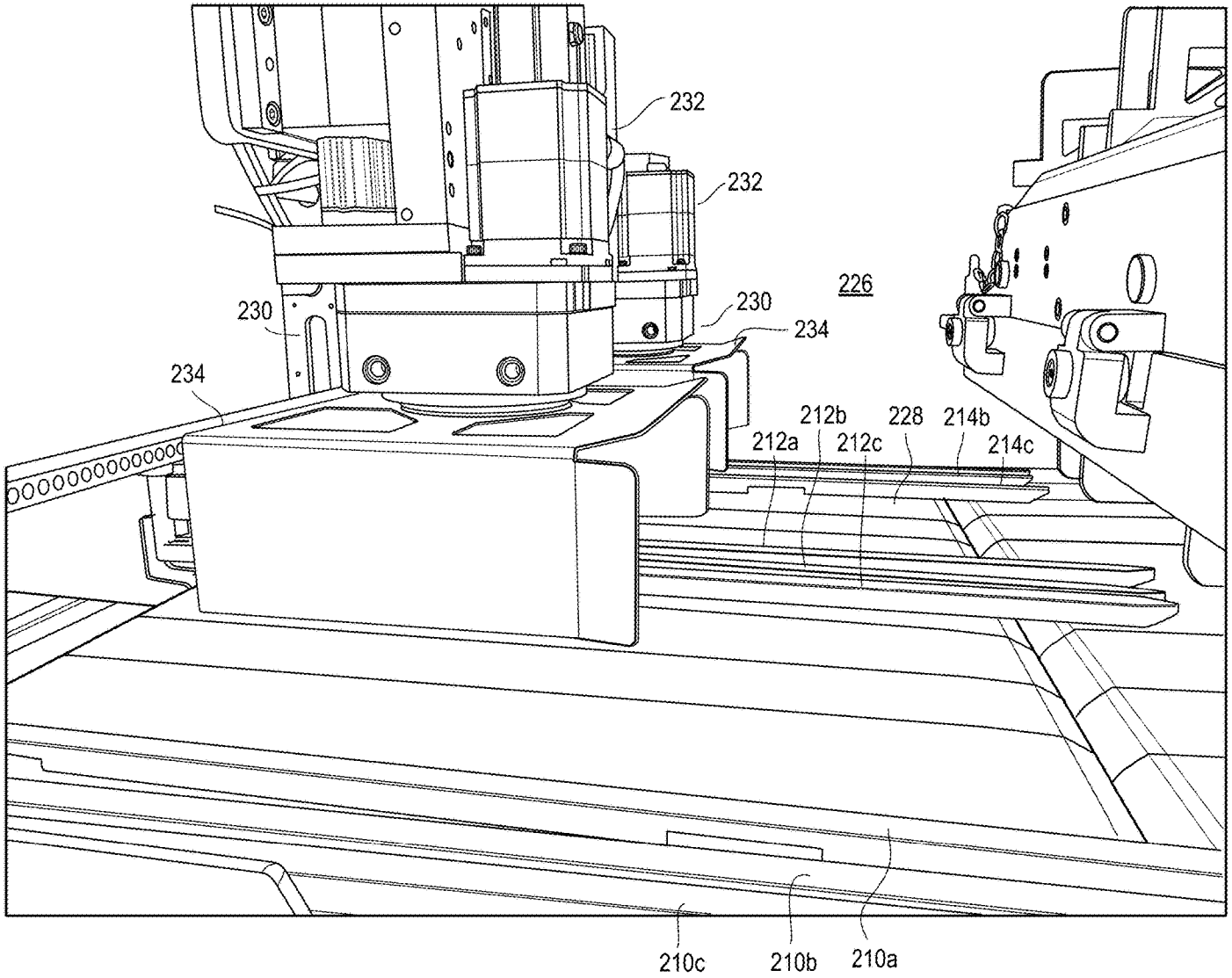
FIG. 14 shows a perspective view of an embodiment of a turning station of the delivery system of FIG. 3.

After the sets of hot dog buns 130 are removed from the lane and the conveyor belt 208, the next sets of hot dog buns 130 enter the lane balancer station 204 for rebalancing as mentioned previously. After being processed by the lane balancer station 204, the sets of hot dog buns 130 are delivered to the turning station 226. As shown in FIG. 14, the turning station 226 includes a conveyor belt 228 similar to conveyor belt 180 described previously. The entire length of the conveyor belt 228 has the left metal guides 210*a-c*, the central metal guides 212*a-c*, and the right metal guides 214*a-e* positioned above the top surface of the conveyor belt 228 so as to define left and right lanes. For each lane, a turner 230 is positioned above the conveyor belt 228. As shown in FIG. 14, each turner 230 has a motor 232 which rotates a spindle (not shown) that is attached to an engager 234. As shown in FIG. 14, the engager 234 has an inverted U-shaped that has three walls, a rectangular-like left side wall 235, a rectangular-like right-side wall 237 parallel to the left side wall 235, and a rectangular-like rear wall 239 that is integrally attached to the left side wall 235 and right-side wall 237. All three walls 235, 237, and 239 are attached to a top piece 241. As shown in FIG. 14, the free ends of the left side wall 235, right-side wall 237 and the top piece 241 are flayed outwards. Each engager 234 defines a cavity that is sized so that a set of hot dog buns 130 is received therein and is engaged by the left side wall 235 and the right-side wall 237.

Figure 14A:
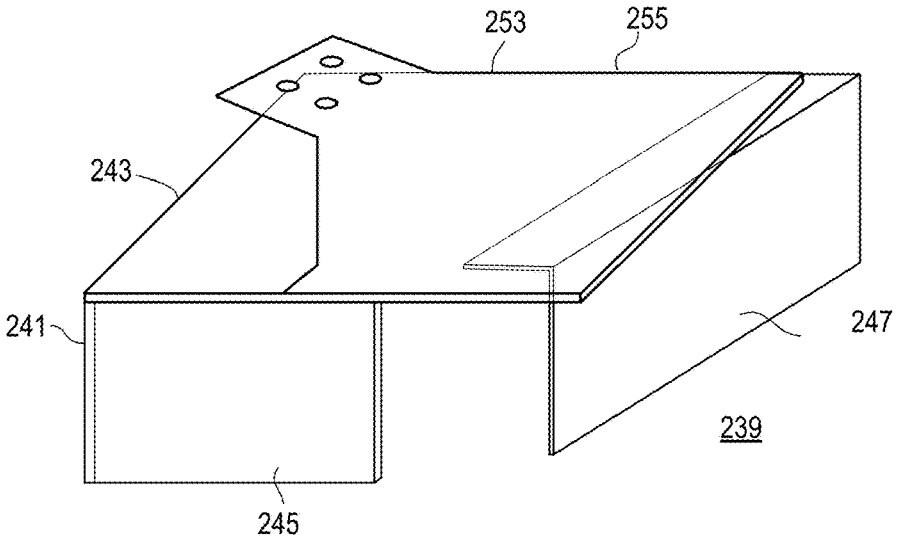
FIG. 14A shows a perspective and schematic view of an embodiment of an engager to be used with the turning station of FIG. 3.
Figure 14B:
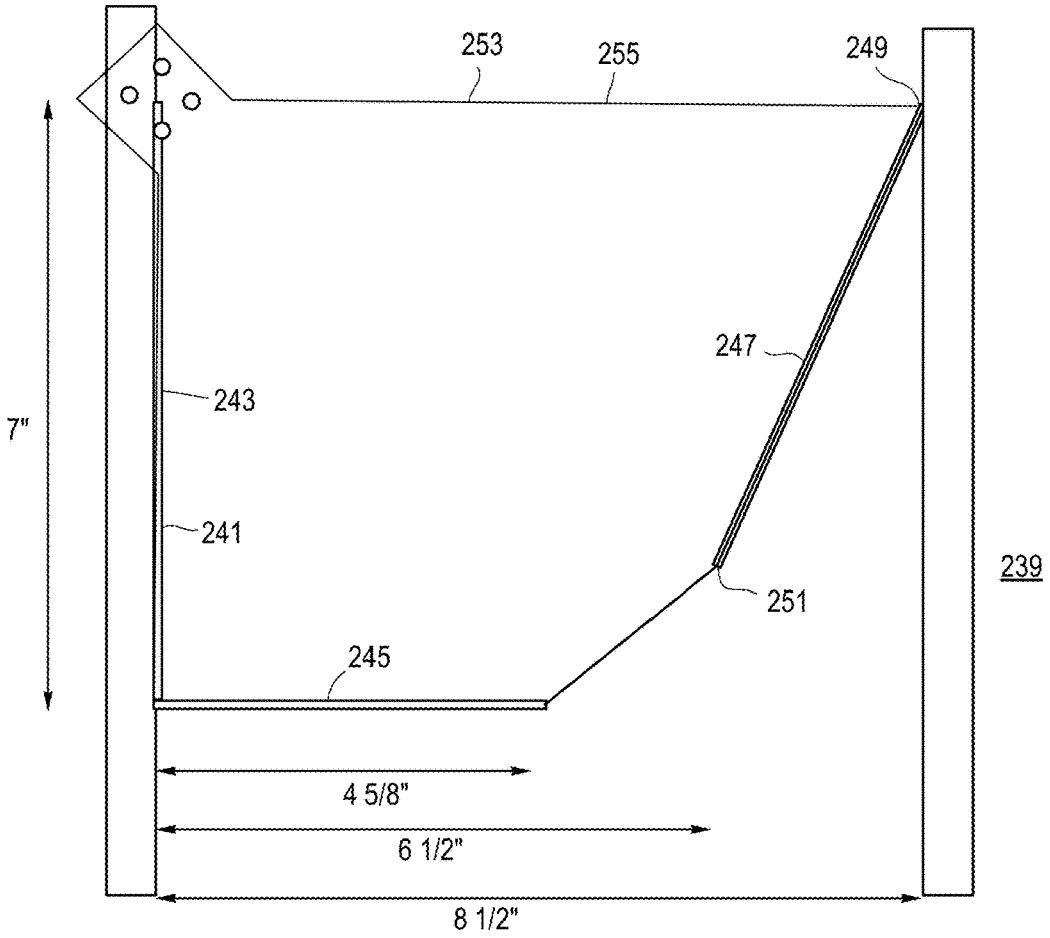
FIG. 14B shows a top view of the engager of FIG. 14A.

An alternative shape for an engager 239 to be attached to the spindle of the turner 230 is shown in FIGS. 14A and 14B. The engager shown has an L-shaped metal piece 241 that define a side wall 243 with a length of approximately 7 inches and a rear wall 245 with a length of approximately 4⅝ inches. The engager includes a metal side wall 247 that has one end 249 positioned 8.5 inches from the side wall 243 and another end 251 positioned 6.5 inches from the side wall 243. The angle of side wall 247 helps to begin rotating the set of hot dog buns 130 as it hits the side wall 247 and aligns with it. The metal piece 241 and the side wall 247 are attached to a top plate 253 so as to define a cavity and an opening 255 that receives the food product from the lane balancer station 204. The metal piece 241 and the side wall 247 have a height of approximately 3 inches. The top plate 253 is attached to the spindle.

In operation, the conveyor belt 228 moves the sets of hot dog buns 130 in the lanes to be underneath the cavity of the engager corresponding to the lane and then stops. At this position, the PLC 174 determines whether any of the set of hot dog buns 130 underneath the engagers were previously designated as not being properly oriented. For a set of hot dog buns 130 so designated, the corresponding engager are rotated from their initial position shown in FIG. 12 and lowered to engage the set of the hot dog buns 130 so that hot dog buns 130 are placed in the cavity of the engager and longitudinal ends of the hot dog buns are visible from a front opening of the engager. Upon engagement, the engager is rotated to the θ=0° position shown in FIG. 12 and defined in FIG. 2. Thus, the set of hot dog buns 130 are properly oriented. Once the set of hot dog buns 130 is properly oriented, the engager is raised to its initial position. Note that the conveyor belt 228 is moving at a constant speed during the entire process of delivering the buns to the turning station 226, moving the buns into the cavities of the engagers and having the engagers orient and disengage the buns. After proper orientation at the turning station 226 is achieved for the set(s) of hot dog buns 130, the conveyor belt 228 is activated and moves the set(s) of hot dog buns 130 to a flipping station 236. Note that the conveyor belt 228 is moving at all times and can be accelerated or decelerated depending on the food item being processed in the turning station 226.

Figure 15A:
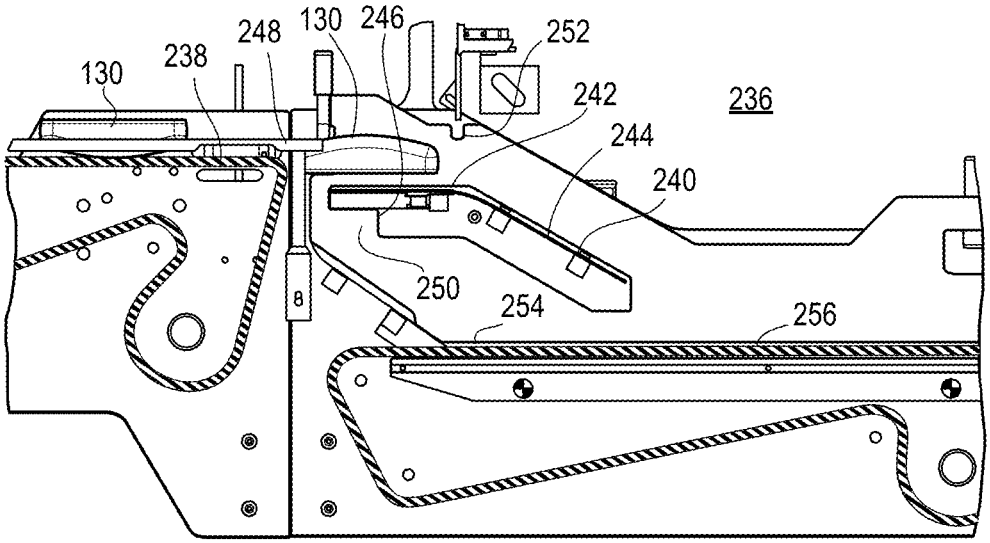
FIG. 15A schematically shows a cross-sectional view of a flipping station of the delivery system of FIG. 3 while performing a first operation.
Figure 15B:
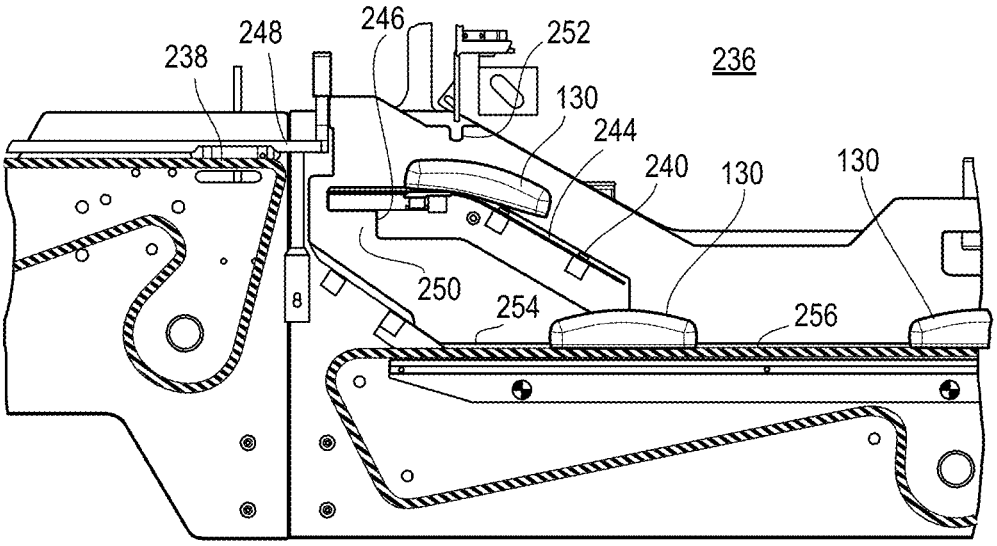
FIG. 15B schematically shows a cross-sectional view of the flipping station of FIG. 15A while performing a second operation.

As shown in FIGS. 15 and 15A-C, the flipping station 236 includes a conveyor belt 238 that defines a moving surface to receive the sets of hot dog buns 130 from conveyor belt 228. As shown in FIGS. 4 and 15A-C, each lane includes a ramp 240 that has a flat landing area 242 and a slanted sliding surface 244. The landing area 242 has a length that is at least one half the length of a set of hot dog buns 130, and the sliding surface 244 has a length of approximately 10 to 12 inches and is angled approximately 30 to 40 degrees relative to the landing area 242. The landing area 242 is parallel to the moving surface of the conveyor belt 238 and is located approximately 1 to 1.5 inches below the moving surface of the conveyor belt 238. The free end 246 of the landing area 242 is spaced from the front end 248 of the conveyor belt 238 by approximately 3.5 inches for a set of hot dog buns 130. Thus, the ramp 240 is spaced from the moving surface of the conveyor belt 238 so that a gap 250 is defined between the moving surface and the ramp 240. The ramp 240 is adjustable in that it moves laterally via a servo motor (not shown) and thus the size of the gap 250 is adjustable. The size of the gap 250 is dependent on the lengths of the food item being Dipped and adjusted so that when the food item is contacted by a pin 250 to be described hereafter, the center of mass of the food item is positioned over the gap 250. In other words, the size of the gap is slightly less than one half of the length of the food item processed by the flipping station 236. As shown in FIGS. 15A-B, the moving surface of the conveyor belt 238 is moving at a sufficient speed so that a food item, such as a set of hot dog buns 130, travels past the gap 250 and lands on the landing area 242 of the ramp 240.

Figure 15C:
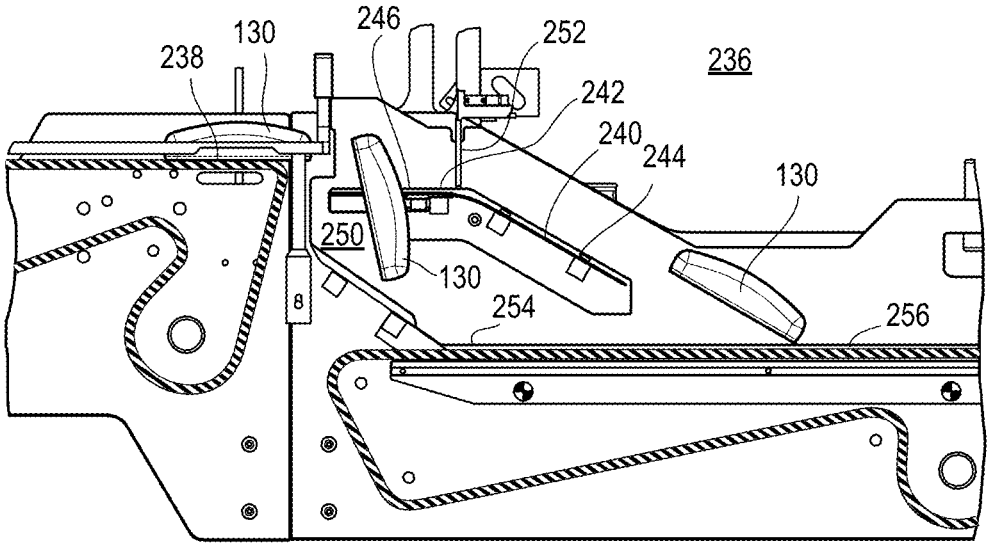
FIG. 15C schematically shows a cross-sectional view of the flipping station of FIG. 15A while performing a third operation.

As shown in FIG. 15C, when a set of hot dog buns 130 has previously been identified as being upside down is moving towards the gap 250, a contact surface of a pin 252 that is positioned past the gap 250 at a contact position and is positioned above the ramp 240 so that the upside-down set of hot dog buns 130 is deflected backwards into the gap 250 and the upside-down set of hot dog buns 130 rotates 180° from the moment of contact with the pin 252 to when it lands right-side up on a landing surface 254 of a conveyor belt 256 located below the ramp 240.

When a set of hot dog buns 130 has previously been identified as right-side up and is food item is present on the conveyor belt 238 and is moving toward the gap 250, pin 252 will be moved or remain at an up position shown in FIGS. 15A and 15B. The right-side up set of hot dog buns 230 travels over the gap 250 and lands on the landing area 242 and then slides down the sliding surface 244 and drops onto the landing surface 254 of conveyor belt 256 and lands so as to remain in the right-side up position. The angle of the sliding surface 244 is chosen so that the food item does not flip over when it is deposited on the landing surface 254.

After being processed by the flipping station, the sets of hot dog buns 130 are moved to conveyor belt 222 (see FIGS. 5H and 5I), which feeds the sets of hot dog buns to a bagger 258. As shown in FIGS. 5H and 5I, there is a digital camera 220 that is similar to cameras 170 and 172 and which is positioned over the conveyor belt 222 of a downstream exit conveyor grouper station 224. The conveyor belt 222 is similar in structure to conveyor belt 108 discussed previously. The camera 220 takes a digital image of the sets of hot dog buns 130 on a top surface of the conveyor belt 222. The digital image is sent to the PLC 174, which identifies each set of hot dogs 130 previously given a unique identifier. The PLC 174 operates a holding mat (not shown) that is similar to holding mat 192 previously described. The PLC 174 is programed to allow every two consecutive sets of hot dog buns 130 to pass past the holding mat and then lower the holding mat. After the two consecutive sets of hot dog buns 130 are a certain distance past the holding mat, the holding mat is raised so that two more consecutive sets of hot dog buns 130 pass past the holding mat and the process is repeated. Each grouping of two consecutive sets of hot dog buns 130 are then packaged in a common bag by the bagger 258. If a different number of food items are to be packaged in a common bag, the timing of the raising and lowering of the holding mat can be adjusted.

Figures 16, 16A, 16B:
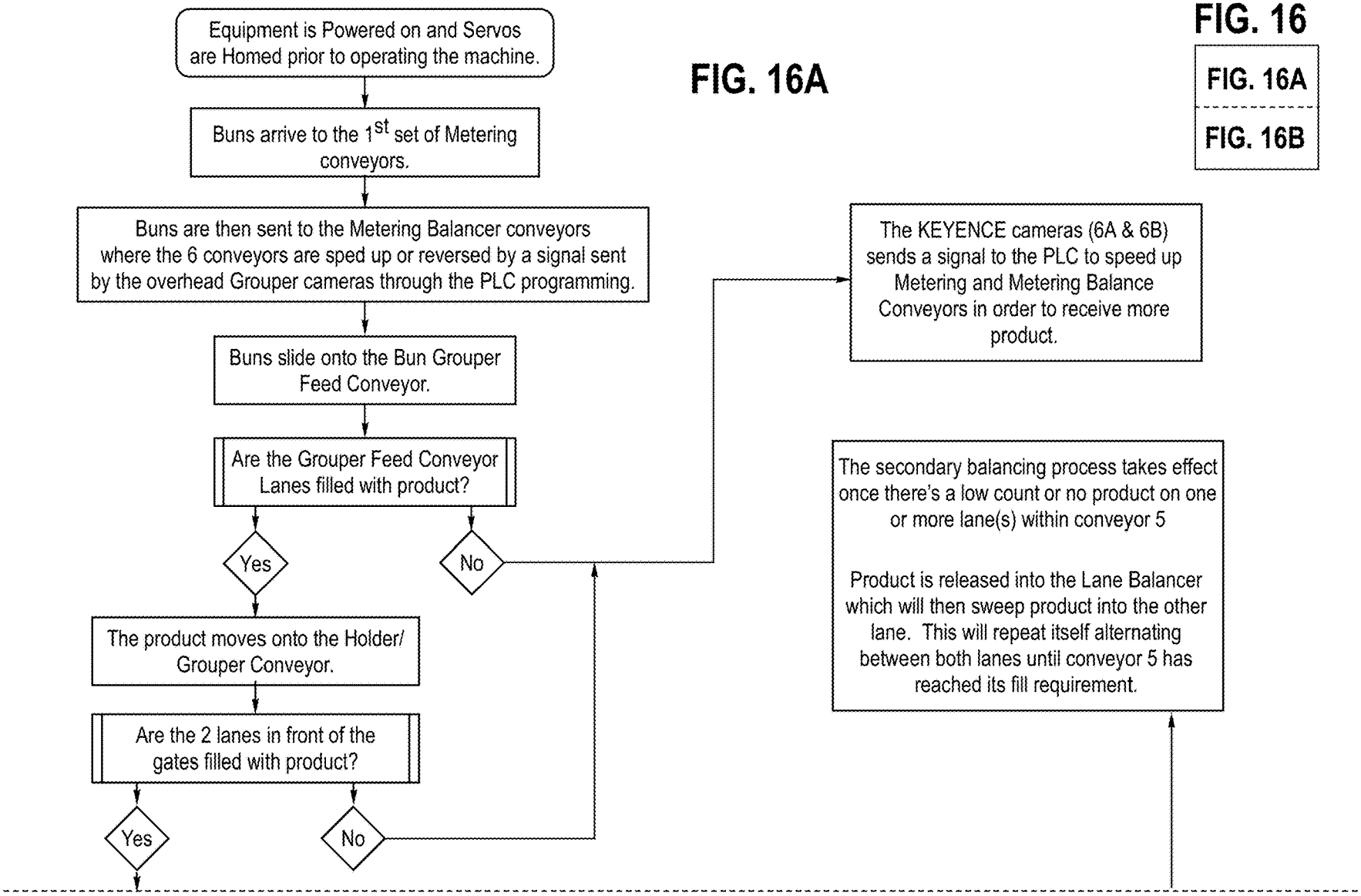
FIGS. 16A-B a flow chart of a possible method of delivering sets of hot dog buns to a bagger.
Figure 16B:
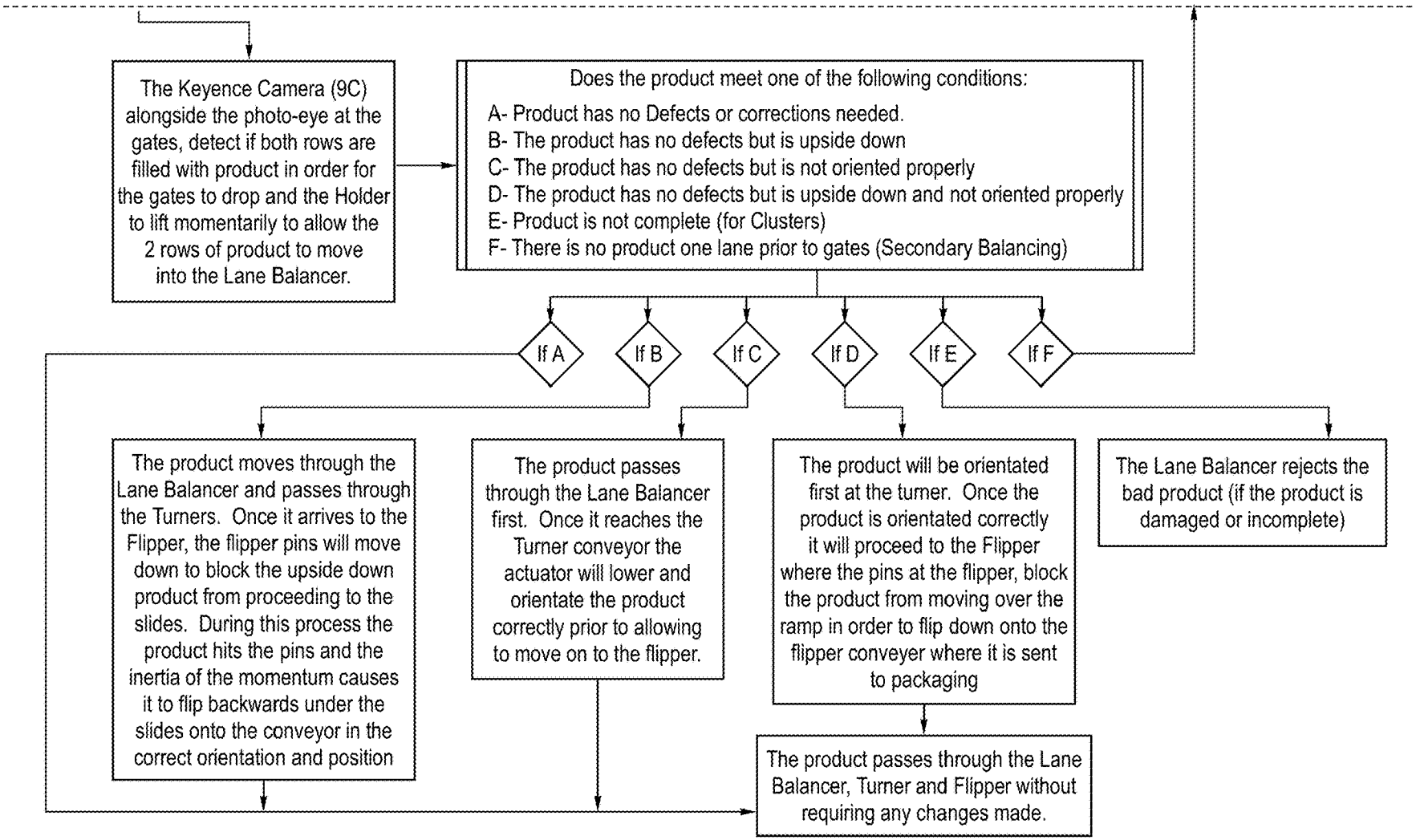

The above processes for delivering the set of hot dog buns 130 is summarized in the flow chart of FIGS. 16A-B. After the appropriate adjustments made regarding lane configurations, conveyor speeds, paddle positioning, ramp angles, and type of food, the above processes can be applied to other foods, such as 1) single hot dog buns, 2) other types of sets of hot dog buns having 2, 3, 5, etc. buns in a set, 3) single hamburger buns, and 4) sets of hamburger buns having 2, 3, 4, etc. buns in a set. The one caveat to the above statement is that in the case of single hamburger buns the angular orientation processes and the turning station 226 do not need to be implemented due to the symmetric circular shape of a single hamburger bun. As explained previously, singular hot dog buns and 2×2, 3×3, etc. sets of hot dog buns and hamburger buns do not need to be turned in the turning station 226.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

We claim:

1. A delivery system comprising:

a balancer station comprising a surface upon which multiple food items are placed;

a grouper station that comprises a surface to receive the multiple food items from the balancer station;

a controller that is in communication with the balancer station and sends control signals to the balancer station to control distribution of the multiple food items of the balancer station to the grouper station;

a camera that generates pixels representing images of each of the multiple food items on the surface of the grouper station, wherein signals based on the pixels are sent from the camera to the controller and the control signals sent to the balancer station are based on numbers of the pixels.

2. The delivery system of claim 1, wherein the camera or controller counts the number of the pixels of each of the multiple food items on the surface of the grouper station, wherein the numbers of the pixels of each of the multiple food items on the surface of the grouper station that are counted are used to generate the control signals sent to the balancer station.

3. The delivery system of claim 2, wherein the number of the pixels of each of the multiple food items on the surface of the grouper station that are counted are aligned along a lane of the surface of the grouper station is used to generate the control signals sent to the balancer station.

4. The delivery system of claim 3, wherein the balancer station comprises multiple conveyor belts that move independently of one another and the control signals sent to the balancer station are used to control each of the multiple conveyor belts independently.

5. The delivery system of claim 1, wherein the balancer station comprises multiple conveyor belts that move independently of one another and the signals from the controller are used to control each of the multiple conveyor belts independently.

6. The delivery system of claim 1, wherein the multiple food items are selected from the group consisting of a hot dog bun or a hamburger bun.

7. The delivery system of claim 6, further comprising a bagger that receives one of the food items and packages the one of the food items in a bag.

8. A method of delivering multiple food items, the method comprising:

placing multiple food items on a surface of a balancer station and receiving on a surface of a grouper station the multiple food items from the balancer station;

controlling distribution of the multiple food items of the balancer station to the grouper station; and generating pixels representing images of each of the multiple food items on the surface of the grouper station, wherein signals based on numbers of the pixels for each of the multiple food items are used for the controlling distribution of the multiple food items of the balancer station to the grouper station.

9. The method of claim 8, further comprising counting the number of the pixels of each of the multiple food items on the surface of the grouper station, wherein the number of the pixels of each of the multiple food items on the surface of the grouper station counted are used for the controlling distribution of the multiple food items of the balancer station to the grouper station.

10. The method of claim 9, wherein the number of the pixels of each of the food items on the surface of the grouper station that are counted are aligned along a lane of the surface of the grouper station is used for the controlling distribution of the multiple food items of the balancer station to the grouper station.

11. The method of claim 10, wherein the controlling distribution comprises independently controlling multiple convey belts of the balancer station.

12. The method of claim 8, wherein the controlling distribution comprises independently controlling multiple convey belts of the balancing station.

13. The method of claim 8, wherein the multiple food items are selected from the group consisting of a hot dog bun or a hamburger bun.

14. The method of claim 13, further comprising packaging one of the multiple food items in a bag.

15. A delivery system comprising:

a grouper station comprising a surface upon which multiple food items are placed;

a balancer station that comprises a surface to receive the multiple food items from the grouper station;

a controller that is in communication with the balancer station and sends control signals to the balancer station to control distribution of the multiple food items of the grouper station to the balancer station;

a camera that generates pixels representing images of each of the multiple food items on the surface of the grouper station, wherein signals based on the pixels are sent from the camera to the controller and the control signals sent to the balancer station are based on numbers of the pixels.

16. The delivery system of claim 15, wherein the camera or controller counts the number of the pixels of each of the multiple food items on the surface of the grouper station, wherein the numbers of the pixels of each of the multiple food items on the surface of the grouper station that are counted are used to generate the control signals sent to the balancer station.

17. The delivery system of claim 16, wherein the number of the pixels of each of the multiple food items on the surface of the grouper station that are counted are aligned along a lane of the surface of the grouper station is used to generate the control signals sent to the balancer station.

18. The delivery system of claim 17, wherein the balancer station comprises multiple paddles that move in unison and the control signals sent to the balancer are used to control movement of the multiple paddles.

19. The delivery system of claim 18, wherein the surface of the balancer station comprises a conveyor belt that moves along a first direction and the multiple paddles are positioned above the conveyor belt and move along a second direction that is perpendicular to the first direction.

20. The delivery system of claim 15, wherein the balancer station comprises multiple paddles that move in unison and the control signals sent to the balancer station are used to control movement of the multiple paddles.

21. The delivery system of claim 20, wherein the surface of the balancer station comprises a conveyor belt that moves along a first direction and the multiple paddles are positioned above the conveyor belt and move along a second direction that is perpendicular to the first direction.

22. The delivery system of claim 15, wherein the multiple food items are selected from the group consisting of a hot dog bun or a hamburger bun.

23. The delivery system of claim 22, further comprising a bagger that receives one of the food items and packages the one of the food items in a bag.

24. A method of delivering multiple food items, the method comprising:

placing multiple food items on a surface of a grouper station and receiving on a surface of a balancer station the multiple food items from the grouper station;

controlling distribution of the multiple food items of the grouper station to the balancer station; and generating pixels representing images of each of the multiple food items on the surface of the grouper station, wherein signals based on numbers of the pixels for each of the multiple food items are used for the controlling distribution of the multiple food items of the grouper station to the balancer station.

25. The method of claim 24, further comprising counting the number of the pixels of each of the multiple food items on the surface of the grouper station, wherein the number of the pixels of each of the multiple food items on the surface of the grouper station counted are used for the controlling distribution of the multiple food items of the grouper station to the balancer station.

26. The method of claim 25, wherein the number of the pixels of each of the food items on the surface of the grouper station that are counted are aligned along a lane of the surface of the grouper station is used for the controlling distribution of the multiple food items of the grouper station to the balancer station.

27. The method of claim 26, wherein the controlling distribution comprises moving multiple paddles in unison.

28. The method of claim 27, wherein the surface of the balancer station moves along a first direction, wherein the method further comprises moving the multiple paddles along a second direction that is perpendicular to the first direction.

29. The method of claim 24, wherein the controlling distribution comprises moving multiple paddles in unison.

30. The method of claim 29, wherein the surface of the balancer station moves along a first direction, wherein the method further comprises moving the multiple paddles along a second direction that is perpendicular to the first direction.

31. The method of claim 24, wherein the multiple food items are selected from the group consisting of a hot dog bun or a hamburger bun.

32. The method of claim 31, further comprising packaging one of the multiple food items in a bag.

* * * * *